US009938614B2

(12) United States Patent
Young et al.

(10) Patent No.: US 9,938,614 B2
(45) Date of Patent: Apr. 10, 2018

(54) AIR SKIVE WITH VAPOR INJECTION

(71) Applicant: Eastman Kodak Company, Rochester, NY (US)

(72) Inventors: Timothy John Young, Williamson, NY (US); Kelvin P. Hill, Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 15/185,341

(22) Filed: Jun. 17, 2016

(65) Prior Publication Data

US 2017/0362693 A1 Dec. 21, 2017

(51) Int. Cl.

| | |
|---|---|
| ***C23C 18/16*** | (2006.01) |
| ***B65H 20/14*** | (2006.01) |
| ***B65H 23/24*** | (2006.01) |
| ***B05C 3/02*** | (2006.01) |
| ***B05C 3/12*** | (2006.01) |
| ***C23C 4/14*** | (2016.01) |
| ***C23C 2/36*** | (2006.01) |
| *B41F 5/24* | (2006.01) |
| *B41F 21/00* | (2006.01) |

(52) U.S. Cl.

CPC ..... *C23C 4/14* (2013.01); *B05C 3/125* (2013.01); *C23C 2/36* (2013.01); *C23C 18/16* (2013.01); *C23C 18/163* (2013.01); *C23C 18/1619* (2013.01); *B41F 5/24* (2013.01); *B41F 21/00* (2013.01); *B65H 20/14* (2013.01); *B65H 2406/111* (2013.01); *B65H 2406/112* (2013.01)

(58) Field of Classification Search

CPC ..... B05C 11/06; B05C 11/02; C23C 2/20; C23C 2/18

See application file for complete search history.

(56) References Cited

U.S. PATENT DOCUMENTS

| | | | | |
|---|---|---|---|---|
| 3,065,098 | A | 11/1962 | Brooks | |
| 3,186,326 | A | 6/1965 | Schmidt | |
| 3,808,033 | A * | 4/1974 | Mayhew | B05C 11/06 118/419 |
| 5,015,509 | A * | 5/1991 | Rey | C23C 2/22 118/405 |
| 5,152,080 | A | 10/1992 | Wimberger | |
| 5,471,847 | A | 12/1995 | Murray et al. | |

(Continued)

FOREIGN PATENT DOCUMENTS

| | | |
|---|---|---|
| DE | 10 2006 027 529 | 12/2007 |
| WO | 2009/044124 | 4/2009 |
| WO | 2013/063188 | 5/2013 |

*Primary Examiner* — Binu Thomas

(74) *Attorney, Agent, or Firm* — Kevin E. Spaulding

(57) ABSTRACT

A web transport system for transporting a web of media along a web transport path in an in-track direction, including a liquid application system for applying a liquid to at least one surface of the web of media. An air skive is positioned along the web transport path downstream of the liquid application system, wherein the air skive directs one or more streams of air onto the web of media thereby removing at least some of the liquid that is being carried along with the web of media. A vapor source adds a vapor into the one or more streams of air provided by the air skive before the one or more streams of air are directed onto the web of media.

17 Claims, 25 Drawing Sheets

(56) References Cited

U.S. PATENT DOCUMENTS

| | | | | |
|---|---|---|---|---|
| 5,958,512 | A * | 9/1999 | Krish | B05C 11/06 427/338 |
| 6,775,925 | B2 | 8/2004 | Zagar et al. | |
| 2013/0192757 | A1 | 8/2013 | Lymn | |
| 2015/0239699 | A1 | 8/2015 | Cornell et al. | |

* cited by examiner

AIR SKIVE WITH VAPOR INJECTION

CROSS-REFERENCE TO RELATED APPLICATIONS

Reference is made to commonly-assigned, co-pending U.S. patent application Ser. No. 14/812,078, entitled "Web transport system including scavenger blade," by K. Hill et al.; to commonly-assigned, co-pending U.S. patent application Ser. No. 15/158,678, entitled "Liquid ejection hole orientation for web guide," by T. Young; and to commonly-assigned, co-pending U.S. patent application Ser. No. 15/158,716, entitled "Liquid ejection hole configuration for web guide," by T. Young; each of which is incorporated herein by reference.

FIELD OF THE INVENTION

This invention pertains to the field of web processing systems, and more particularly to web transport systems including an air skive for removing liquid from a web of media.

BACKGROUND OF THE INVENTION

Processing a web of media in a roll-to-roll fashion can be an advantageous and low-cost manufacturing approach for devices or other objects formed on the web of media. A number of manufacturing methods, such as etching, plating, developing, or rinsing include processing the media in a tank of liquid chemicals. Transporting the web of media through the liquid chemicals can provide technical challenges, especially if rollers are used to guide the web of media, as is conventionally done. An example of a process that includes web transport through liquid chemicals is roll-to-roll electroless plating.

Electroless plating, also known as chemical or autocatalytic plating, is a plating process that involves chemical reactions in an aqueous plating solution that occur without the use of external electrical power. Typically, the plating occurs as hydrogen is released by a reducing agent and oxidized, thus producing a negative charge on the surface of the part to be plated. The negative charge attracts metal ions out of the plating solution to adhere as a metalized layer onto the surface. Using electroless plating to provide metallization in predetermined locations can be facilitated by first depositing a catalytic material in the predetermined locations. This can be done, for example, by printing features using an ink containing a catalytic component. Conventionally, electroless plating has typically been performed by immersing the item to be plated in a tank of plating solution. However, for high volume plating of features on both sides of a web of substrate material, it is preferable to perform the electroless plating in a roll-to-roll electroless plating system.

Touch screens are visual displays with areas that can be configured to detect both the presence and location of a touch by, for example, a finger, a hand or a stylus. Touch screens can be found in many common devices such as televisions, computers, computer peripherals, mobile computing devices, automobiles, appliances and game consoles, as well as in other industrial, commercial and household applications. A capacitive touch screen includes a substantially transparent substrate which is provided with electrically conductive patterns that do not excessively impair the transparency-either because the conductors are made of a material, such as indium tin oxide, that is substantially transparent, or because the conductors are sufficiently narrow that the transparency is provided by the comparatively large open areas not containing conductors. For capacitive touch screens having metallic conductors, it is advantageous for the features to be highly conductive but also very narrow. Capacitive touch screen sensor films are examples of articles having very fine features with improved electrical conductivity resulting from an electrolessly-plated metal layer.

Projected capacitive touch technology is a variant of capacitive touch technology. Projected capacitive touch screens are made up of a matrix of rows and columns of conductive material that form a grid. Voltage applied to this grid creates a uniform electrostatic field, which can be measured. When a conductive object, such as a finger, comes into contact, it distorts the local electrostatic field at that point. This is measurable as a change in capacitance. The capacitance can be measured at every intersection point on the grid. In this way, the system is able to accurately track touches. Projected capacitive touch screens can use either mutual capacitive sensors or self capacitive sensors. In mutual capacitive sensors, there is a capacitor at every intersection of each row and each column. A 16×14 array, for example, would have 224 independent capacitors. A voltage is applied to the rows or columns. Bringing a finger or conductive stylus close to the surface of the sensor changes the local electrostatic field which reduces the mutual capacitance. The capacitance change at every individual point on the grid can be measured to accurately determine the touch location by measuring the voltage in the other axis. Mutual capacitance permits multi-touch operation where multiple fingers, palms or styli can be accurately tracked at the same time.

WO 2013/063188 (Petcavich et al.), entitled "Method of manufacturing a capacitive touch sensor circuit using a roll-to-roll process to print a conductive microscopic patterns on a flexible dielectric substrate," discloses a method of manufacturing a capacitive touch sensor using a roll-to-roll process to print a conductor pattern on a flexible transparent dielectric substrate. A first conductor pattern is printed on a first side of the dielectric substrate using a first flexographic printing plate, and is then cured. A second conductor pattern is printed on a second side of the dielectric substrate using a second flexographic printing plate, and is then cured. The ink used to print the patterns includes a catalyst that acts as seed layer during a subsequent electroless plating operation. The electrolessly-plated material (e.g., copper) provides the low resistivity in the narrow lines of the grid needed for excellent performance of the capacitive touch sensor. Petcavich et al. indicate that the line width of the flexographically-printed material can be 1 to 50 microns.

Flexography is a method of printing or pattern formation that is commonly used for high-volume printing runs. It is typically employed in a roll-to-roll format for printing on a variety of soft or easily deformed materials including, but not limited to, paper, paperboard stock, corrugated board, polymeric films, fabrics, metal foils, glass, glass-coated materials, flexible glass materials and laminates of multiple materials. Coarse surfaces and stretchable polymeric films are also economically printed using flexography.

Flexographic printing members are sometimes known as relief printing members, relief-containing printing plates, printing sleeves, or printing cylinders, and are provided with raised relief images onto which ink is applied for application to a printable material. While the raised relief images are inked, the recessed relief "floor" should remain free of ink.

Although flexographic printing has conventionally been used in the past for printing of images, more recent uses of flexographic printing have included functional printing of devices, such as touch screen sensor films, antennas, and other devices to be used in electronics or other industries. Such devices typically include electrically conductive patterns.

To improve the optical quality and reliability of the touch screen, it has been found to be preferable that the width of the grid lines be approximately 2 to 10 microns, and even more preferably to be 4 to 8 microns. In addition, in order to be compatible with the high-volume roll-to-roll manufacturing process, it is preferable for the roll of flexographically printed material to be electrolessly plated in a roll-to-roll electroless plating system.

Patterns, especially fine line patterns that are plated using electroless plating systems, are often delicate and susceptible to being damaged as the web of substrate is transported along the web-transport path. For example, particulates can be located on the media support surface of a roller that contacts the web surface and cause scratches as the web of media passes. Therefore, it is desirable to minimize contact between the web of media and hard surfaces where abrasion can occur.

WO 2009/044124 (Lymn), entitled "Web processing machine," discloses a web transport system using submerged fluid bearings in which process liquid is directed through apertures to lift the web of media away from the bearing surface. In Lymn's preferred embodiment, it is contemplated that non-submerged upper web guides that are located above the liquid level can also use fluid bearings where air is used as the fluid. However, Lymn also contemplates using process liquid in place of air in a non-submerged upper web. U.S. Patent Application Publication No. 2013/0192757 (Lymn), also entitled "Web processing machine," describes a configuration including drying guides over a processing tank. The guides have outlet slits through which air is blown to provide a bearing medium as well as a drying medium.

U.S. Pat. No. 3,065,098 (Brooks), entitled "Method for coating webs" provides air ejected through tubes to float a web along an undulating path. The holes are formed radially in the tube walls.

U.S. Pat. No. 3,186,326 (Schmidt), entitled "Fluid bearings for strip material" teaches ejecting processing liquid through holes in a tube for providing a fluid bearing for a web of media.

An objective for web guides that support the web of media using liquid bearings or air bearings (i.e., turn bars) is to provide sufficient standoff (i.e., the distance between the web of media and the surface of the web guide) in order to reduce the likelihood of the web of media contacting the web guide surface.

When a web of media travels through a web processing system, processing liquid from one processing step can be carried to downstream portions of the web transport path, thereby wasting the processing liquid and contaminating downstream processing operations. Air skives or air dryers can be used to remove the processing liquid from the web of media. The use of air turn bars, air skives, air dryers or air turn bars can result in non-uniform drying and can produce various artifacts. Compression of the air can heat the air, thereby increasing the evaporation rate which exacerbates these problems.

U.S. Pat. No. 5,152,080 (Wimberger), entitled "Steerable air bar/edge dam apparatus," discloses an air bar that can be used to both steer the web and dry it.

U.S. Patent Application Publication No. 2013/0192757 discloses a web having a sinusoidal path around submerged guides in a liquid processing tank and drying guides above the tank, where the drying guides have outlet slits through which air is blown, so that the air acts both as a bearing medium and as a drying medium.

U.S. Pat. No. 6,775,925 (Zagar et al.), entitled "Water spray web cooling apparatus for web dryer," discloses spraying a water mist onto a web in order to cool the web and remoisten it after the web exits from a dryer. U.S. Pat. No. 5,471,847 (Murray et al.), entitled "Web cooling device," discloses applying a liquid to both sides of a hot web to cool it by evaporative cooling. If such configurations were used while the web was still above a liquid processing tank, excess water droplets would fall into the tank and would thereby dilute the processing solution.

There remains a need for improved web transport systems using air turn bars, air skives or air dryers that can reduce the occurrence of artifacts which result from non-uniform drying of the media.

SUMMARY OF THE INVENTION

The present invention represents a web transport system for transporting a web of media along a web transport path in an in-track direction, including:

a liquid application system for applying a liquid to at least one surface of the web of media;

an air skive positioned along the web transport path downstream of the liquid application system, wherein the air skive directs one or more streams of air onto the web of media thereby removing at least some of the liquid that is being carried along with the web of media; and a vapor source that adds a vapor into the one or more streams of air provided by the air skive before the one or more streams of air are directed onto the web of media.

This invention has the advantage that the air skive provides air including a vapor to impinge upon the web of media in order to remove liquid from the surface of the web of media while reducing artifacts associated with uneven drying of the media surface.

It has the additional advantage that the vapor cools the air, further reducing drying artifacts by reducing the evaporation rate of liquid from the media surface.

Figure 1:
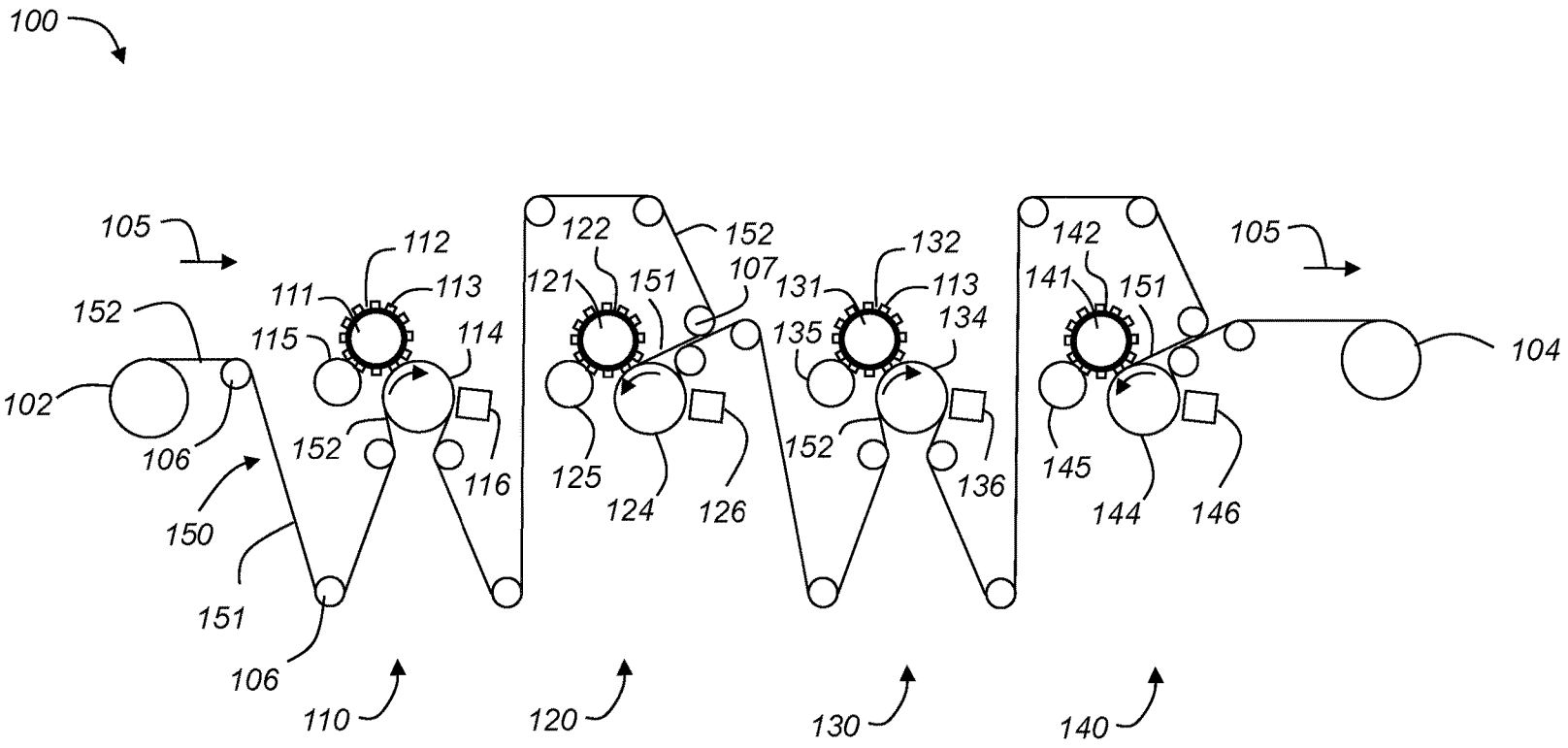
FIG. 1 is a schematic side view of a flexographic printing system for roll-to-roll printing on both sides of a web of media.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. It should be noted that, unless otherwise explicitly noted or required by context, the word "or" is used in this disclosure in a non-exclusive sense.

The exemplary embodiments of the present invention are illustrated schematically and not to scale for the sake of clarity. One of ordinary skill in the art will be able to readily determine the specific size and interconnections of the elements of the example embodiments of the present invention.

References to upstream and downstream herein refer to direction of flow. A web of media moves along a media path in a web advance direction from upstream to downstream. Similarly, fluids flow through a fluid line in a direction from upstream to downstream. In some instances, a fluid can flow in an opposite direction from the web advance direction. For clarification herein, upstream and downstream are meant to refer to the web motion unless otherwise noted.

As described herein, the exemplary embodiments of the present invention describe a roll-to-roll electroless plating system for providing web transport without contacting the surface of the web with a hard surface such as a roller. The roll-to-roll electroless plating system is useful for metalizing printed features in sensor films incorporated into touch screens. However, many other applications are emerging for printing and electroless plating of functional devices that can be incorporated into other electronic, communications, industrial, household, packaging and product identification systems (such as RFID) in addition to touch screens. In addition, roll-to-roll electroless plating systems can be used to plate items for decorative purposes rather than electronic purposes and such applications are contemplated as well. Furthermore, there are many other applications of liquid processing of a web of media in a roll-to-roll configuration in addition to electroless plating. There can also be applications of roll-to-roll web transport where a liquid bearing can be used for guiding a web of media without contact and where no liquid processing or tanks of processing liquids are used.

FIG. 1 is a schematic side view of a flexographic printing system 100 that can be used for roll-to-roll printing of a catalytic ink on both sides of a substrate 150 for subsequent electroless plating. Substrate 150 is fed as a web of media from supply roll 102 to take-up roll 104 through flexographic printing system 100. Substrate 150 has a first side 151 and a second side 152. Within the context of the present disclosure, the term "web of media" is used interchangeably with the terms "substrate" or "web of substrate."

The flexographic printing system 100 includes two print modules 120 and 140 that are configured to print on the first side 151 of substrate 150, as well as two print modules 110 and 130 that are configured to print on the second side 152 of substrate 150. The web of substrate 150 travels overall in roll-to-roll direction 105 (left to right in the example of FIG. 1). However, various rollers 106 and 107 are used to locally change the direction of the web of substrate 150 as needed for adjusting web tension, providing a buffer, and reversing the substrate 150 for printing on an opposite side. In particular, note that in print module 120 roller 107 serves to reverse the local direction of the web of substrate 150 so that it is moving substantially in a right-to-left direction.

Each of the print modules 110, 120, 130, 140 includes some similar components including a respective plate cylinder 111, 121, 131, 141, on which is mounted a respective flexographic printing plate 112, 122, 132, 142, respectively. Each flexographic printing plate 112, 122, 132, 142 has raised features 113 defining an image pattern to be printed on the substrate 150. Each print module 110, 120, 130, 140 also includes a respective impression cylinder 114, 124, 134, 144 that is configured to force a side of the substrate 150 into contact with the corresponding flexographic printing plate 112, 122, 132, 142. Impression cylinders 124 and 144 of print modules 120 and 140 (for printing on first side 151 of substrate 150) rotate counter-clockwise in the view shown in FIG. 1, while impression cylinders 114 and 134 of print modules 110 and 130 (for printing on second side 152 of substrate 150) rotate clockwise in this view.

Each print module 110, 120, 130, 140 also includes a respective anilox roller 115, 125, 135, 145 for providing ink to the corresponding flexographic printing plate 112, 122, 132, 142. As is well known in the printing industry, an anilox roller is a hard cylinder, usually constructed of a steel or aluminum core, having an outer surface containing millions of very fine dimples, known as cells. Ink is provided to the anilox roller by a tray or chambered reservoir (not shown). In some embodiments, some or all of the print modules 110, 120, 130, 140 also include respective UV curing stations 116, 126, 136, 146 for curing the printed ink on substrate 150.

Figure 2:
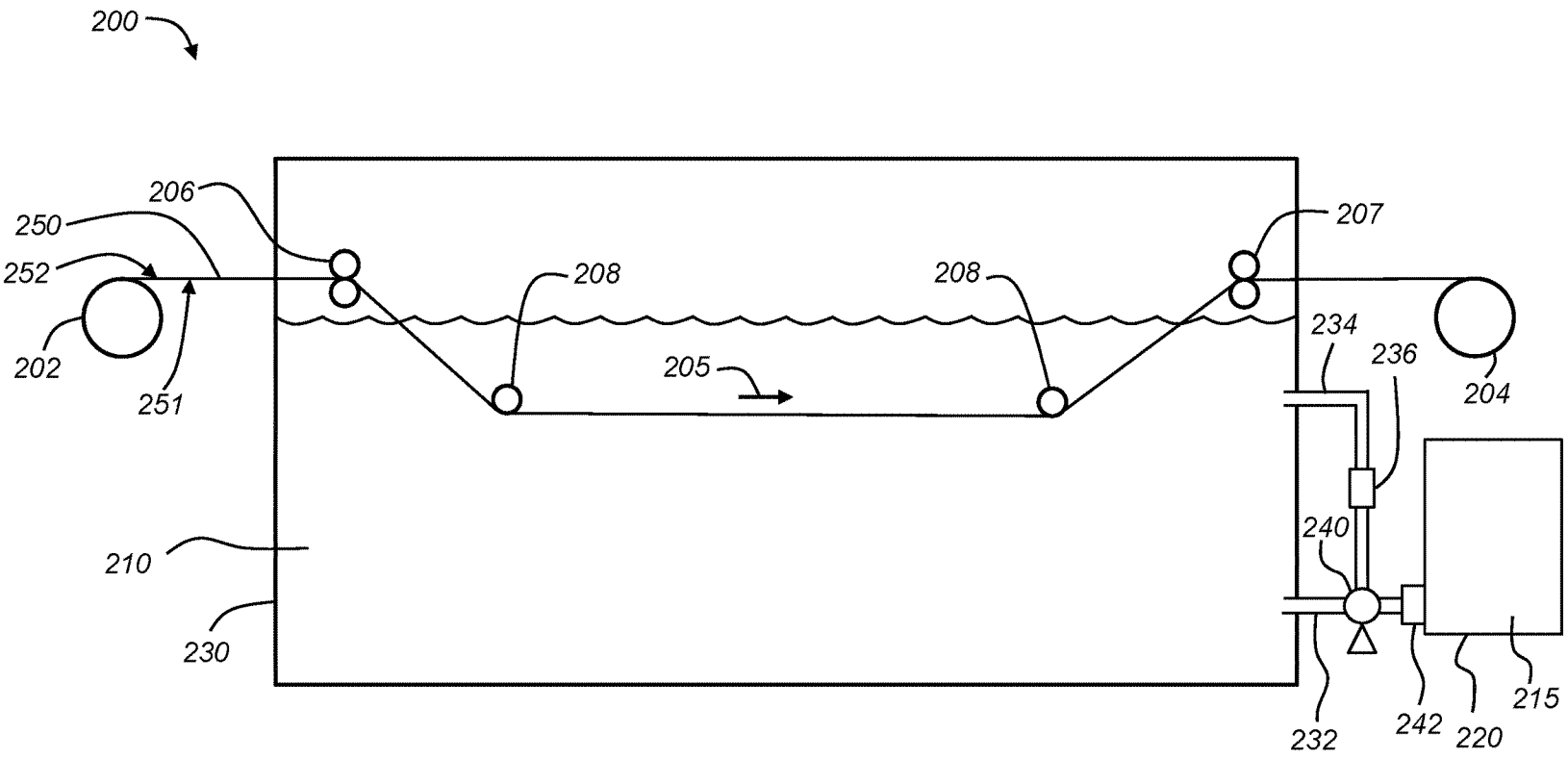
FIG. 2 (Prior Art)
FIG. 2 is a schematic side view of a roll-to-roll electroless plating system.

FIG. 2 is a schematic side view of a roll-to-roll electroless plating system 200 disclosed in commonly-assigned, co-pending U.S. patent application Ser. No. 14/571,328 entitled "Roll-to-roll electroless plating system with liquid flow bearing," by S. Reuter et al., which is incorporated herein by reference. The roll-to-roll electroless plating system 200 includes a tank 230 of plating solution 210. A web of media 250 is fed by a web advance system along a web-transport path in an in-track direction 205 from a supply roll 202 to a take-up roll 204. The web of media 250 is a substrate upon which electroless plating is to be performed. A drive roller 206 is positioned upstream of the plating solution 210 and a drive roller 207 is positioned downstream of the plating solution 210. Drive rollers 206 and 207 advance the web of media 250 from the supply roll 202 through the tank of plating solution 210 to the take-up roll 204. Web-guiding rollers 208 are at least partially submerged in the plating solution 210 in the tank 230 and guide the web of media 250 along the web-transport path in the in-track direction 205.

As the web of media 250 is advanced through the plating solution 210 in the tank 230, a metallic plating substance such as copper, silver, gold, nickel or palladium is electrolessly plated from the plating solution 210 onto predetermined locations on one or both of a first surface 251 and a second surface 252 of the web of media 250. As a result, the concentration of the metal or other components in the plating solution 210 in the tank 230 decreases and the plating solution 210 needs to be refreshed. To refresh the plating solution 210, it is recirculated by a pump 240, and replenished plating solution 215 from a reservoir 220 is added under the control of a controller 242, which can include a valve (not shown). In the example shown in FIG. 2, plating solution 210 is moved from tank 230 to pump 240 through a drain pipe 232 and is returned from pump 240 to tank 230 through a return pipe 234. In order to remove particulates from plating solution 210, a filter 236 can be included, typically downstream of the pump 240.

Particulates can be present in plating solution 210 due to contaminants that enter from outside of the tank 230, or can be generated from hardware within tank 230, or can result from spontaneous plating out of metal from the electroless plating solution 210. Particulates that settle on the bottom of the tank 230 do not represent a significant problem. However, particulates that fall onto the web of media 250 and become trapped between web of media 250 and one of the drive rollers 206, 207 or web-guiding rollers 208 can cause significant problems due to scratching of the delicate patterns formed on the web of media 250. In some cases, a particulate can become embedded in a roller and cause scratches in successive portions of the web of media 250 that contact it.

Figure 3:
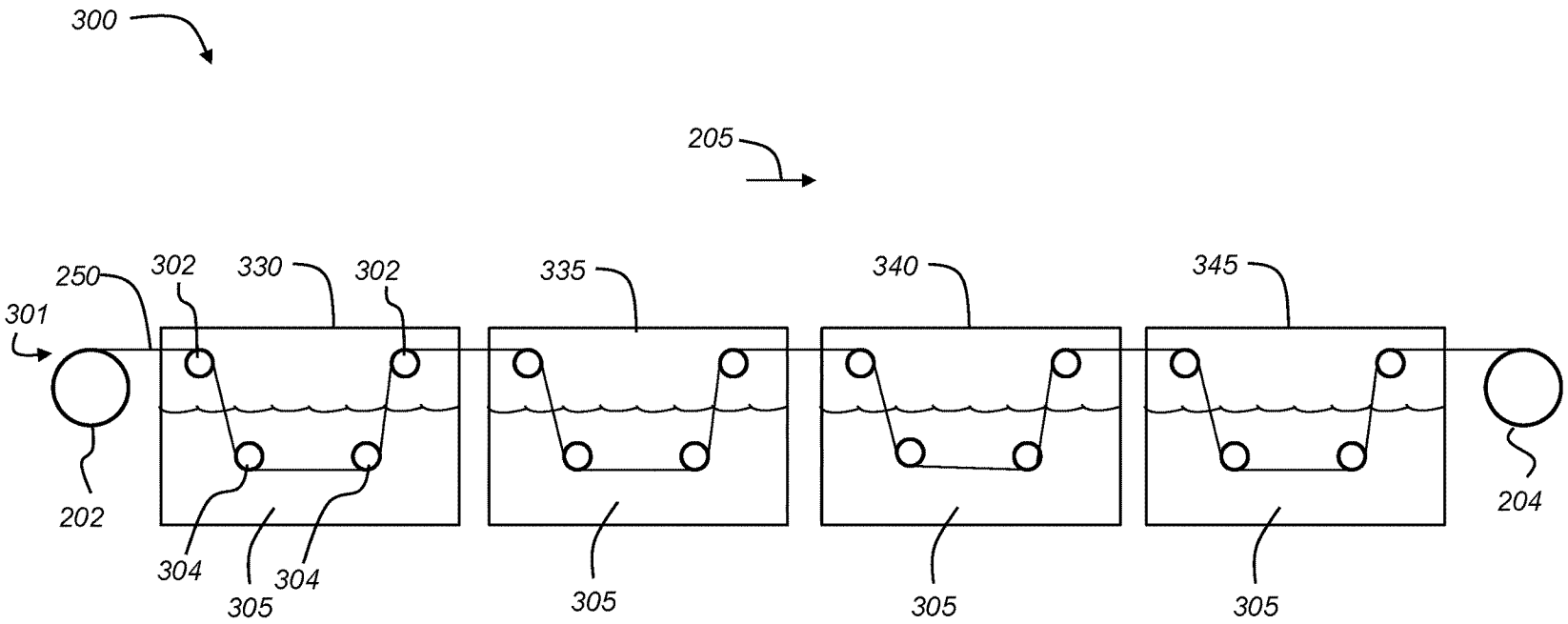
FIG. 3 is a schematic side view of a multi-stage roll-to-roll liquid processing system.

A roll-to-roll liquid processing system 300 for processing a web of media 250 can have a plurality of processing tanks 330, 335, 340, 345, as shown schematically in FIG. 3. The web of media 250 is transported successively through the processing tanks 330, 335, 340, 345 by web transport system 301 as it travels from the supply roll 202 to the take-up roll 204. Each successive processing tank 330, 335, 340, 345 can contain a different processing liquid 305, or some or all of the processing tanks 330, 335, 340, 345 can contain the same processing liquid 305.

In an exemplary configuration, the roll-to-roll liquid processing system 300 is an electroless plating line for plating touch screen sensor films on catalytic ink patterns printed by flexographic printing system 100 of FIG. 1. In this case, the processing tanks 330, 340 can be plating tanks containing electroless plating solution, and the processing tanks 335, 345 can be rinse tanks containing a rinsing liquid. For example, the processing liquid 305 in processing tank 330 can be a copper plating solution; the processing liquid 305 in processing tank 335 can be water for rinsing the web of media 250; the processing liquid 305 in processing tank 340 can be a palladium plating solution; and the processing liquid 305 in processing tank 345 can be water for rinsing the web of media 250.

The web of media 250 is transported along in-track direction 205 into each successive processing tank 330, 335, 340, 345 where it is submerged in the associated processing liquid 305, and then transported out of the processing tank 330, 335, 340, 345 and into the next processing tank 330, 335, 340, 345, and finally to the take-up roll 204. Web transport guides for each tank include both non-submerged web guides 302 and submerged web guides 304.

Commonly-assigned, co-pending U.S. patent application Ser. No. 14/812,078 to Hill et al., entitled "Web transport system including scavenger blade," which is incorporated herein by reference, teaches the use of a scavenger blade to remove at least some liquid that was ejected at the bearing surface of a non-submerged web guide or web guide from the surface of the web of media. Such scavenger blades can be useful in conjunction with the non-submerged web guides 302 of FIG. 3.

Damage to the web of media caused by particulates that become trapped between web of media 250 and one of the drive rollers 206, 207 or web-guiding rollers 208 can be eliminated by using non-contact web guides to guide the web of media as it passes through and between the different liquid processing tanks 330, 335, 340, and 345. Embodiments of the invention provide improved performance of web guides that support a web of media using liquid bearings. In particular, the disclosed liquid bearing configurations provide sufficient stand-off (i.e., the distance between the web of media 250 and the surface of the web guide) to reduce the likelihood of the web of media 250 contacting the web guide surface. The disclosed configurations have the advantage that they provide non-contact web guidance at a relatively low flow rate of ejected liquid in the liquid bearings. In addition, stable web transport without appreciable web flutter is provided. Furthermore, improved control of the ejection of liquid is provided such that the ejected liquid is not wasted and does not cause contamination.

Figure 4:
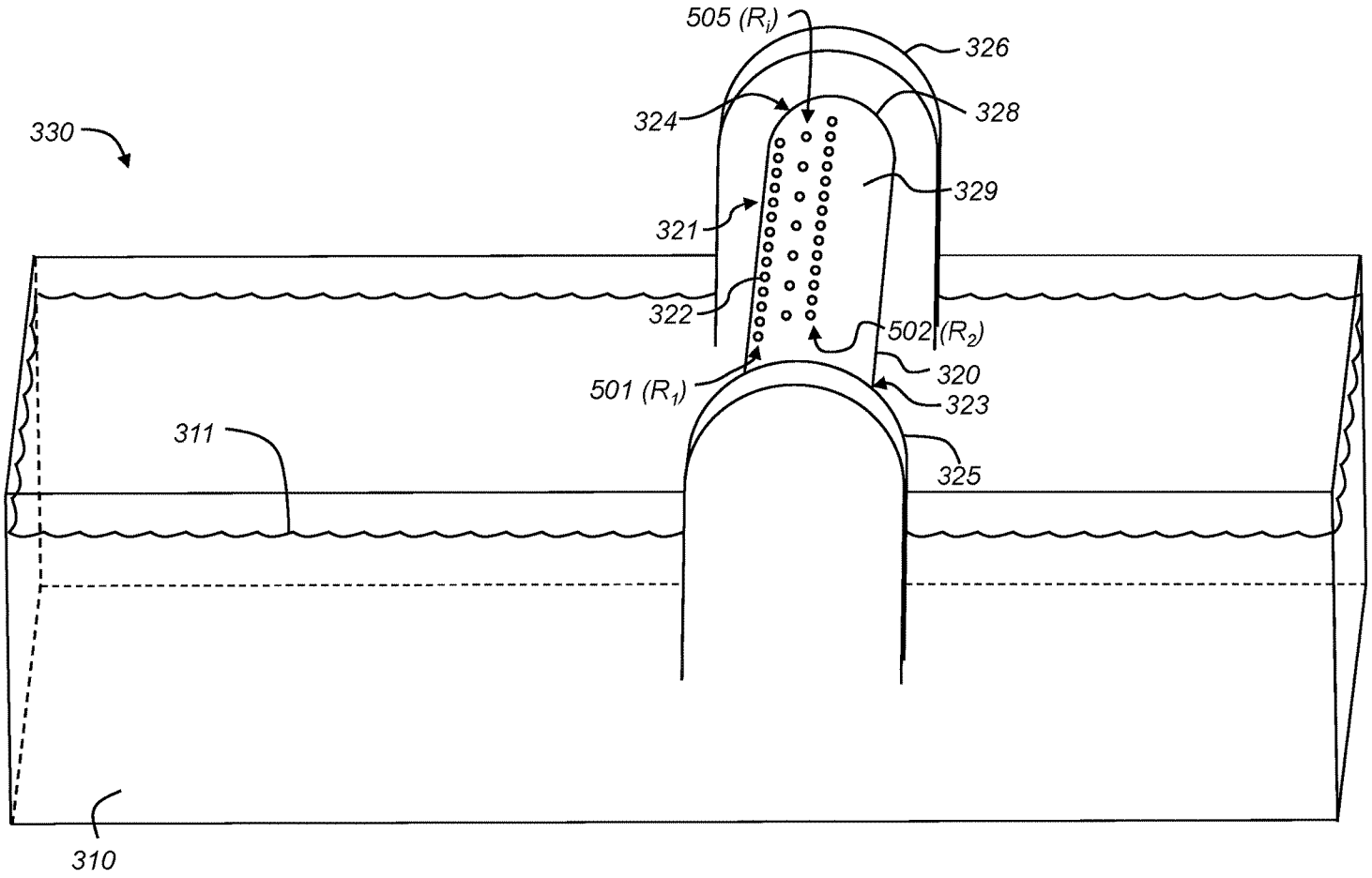
FIG. 4 is a cutaway perspective of a processing tank including a non-submerged non-contact web guide.

FIG. 4 is a perspective of a processing tank 330 including a reservoir of processing liquid 310 (e.g., a plating solution) that fills the processing tank 330 up to a liquid level 311. A non-contact web guide 320 has a curved wall 328 with a curved exterior surface 329. The curved exterior surface 329 has an arrangement of liquid ejection holes 322 within or near a bearing surface 321 portion. While various arrangements of liquid ejection holes 322 can be used, one desirable arrangement is that disclosed in commonly-assigned, co-pending U.S. paatent pplication Ser. No. 15/158,678 to T. Young, entitled "Liquid ejection hole orientation for web guide," and commonly-assigned, co-pending U.S. patent application Ser. No. 15/158,716 to T. Young, entitled "Liquid ejection hole configuration for web guide," both of which are incorporated herein by reference. In this configuration, which is illustrated in FIG. 4, the arrangement of liquid ejection holes 322 includes a first array 501, a second array 502, and an optional intermediate array 505 that is disposed between the first array 501 and the second array 502. In the illustrated arrangement, there are fewer liquid ejection holes 322 in the intermediate array 505 than there are in either the first array 501 or the second array 502, although this is not required. In other embodiments, some or all of the arrays of liquid ejection holes 322 can be two-dimensional arrays including liquid ejection holes 322 distributed along a plurality of lines, or can include liquid ejection holes 322 arranged in other types of patterns such as hexagonal patterns.

Preferably, bearing surface 321 has a smooth cross-section. In the illustrated configuration, the curved exterior surface 329 of the web guide 320 has a circular cross-section so that the cross-section of the bearing surface 321 is a circular arc.

Web guide 320 is supported at its first end 323 by a first mount 325, and at its second end 324 by a second mount 326. Processing liquid 310 is forced through the liquid ejection holes 322 by a pump (not shown). Web guide 320 can have a hollow interior 327 (see FIG. 7) that is in fluidic communication with the liquid ejection holes 322. Processing liquid 310 can be supplied to the web guide 320 through appropriate plumbing (not shown) between the pump and the hollow interior 327. In some configurations, the plumbing can be adjacent to or within one or both of the first mount 325 and the second mount 326.

In the exemplary configuration of FIG. 4, the liquid ejection holes 322 in the web guide 320 are above the liquid level 311 (although other portions of the web guide 320 may or may not be above liquid level 311). In the terminology used herein, a web guide 320 is said to be "non-submerged" if at least some of the liquid ejection holes 322 through which processing liquid 310 is ejected are above liquid level 311.

Figure 5:
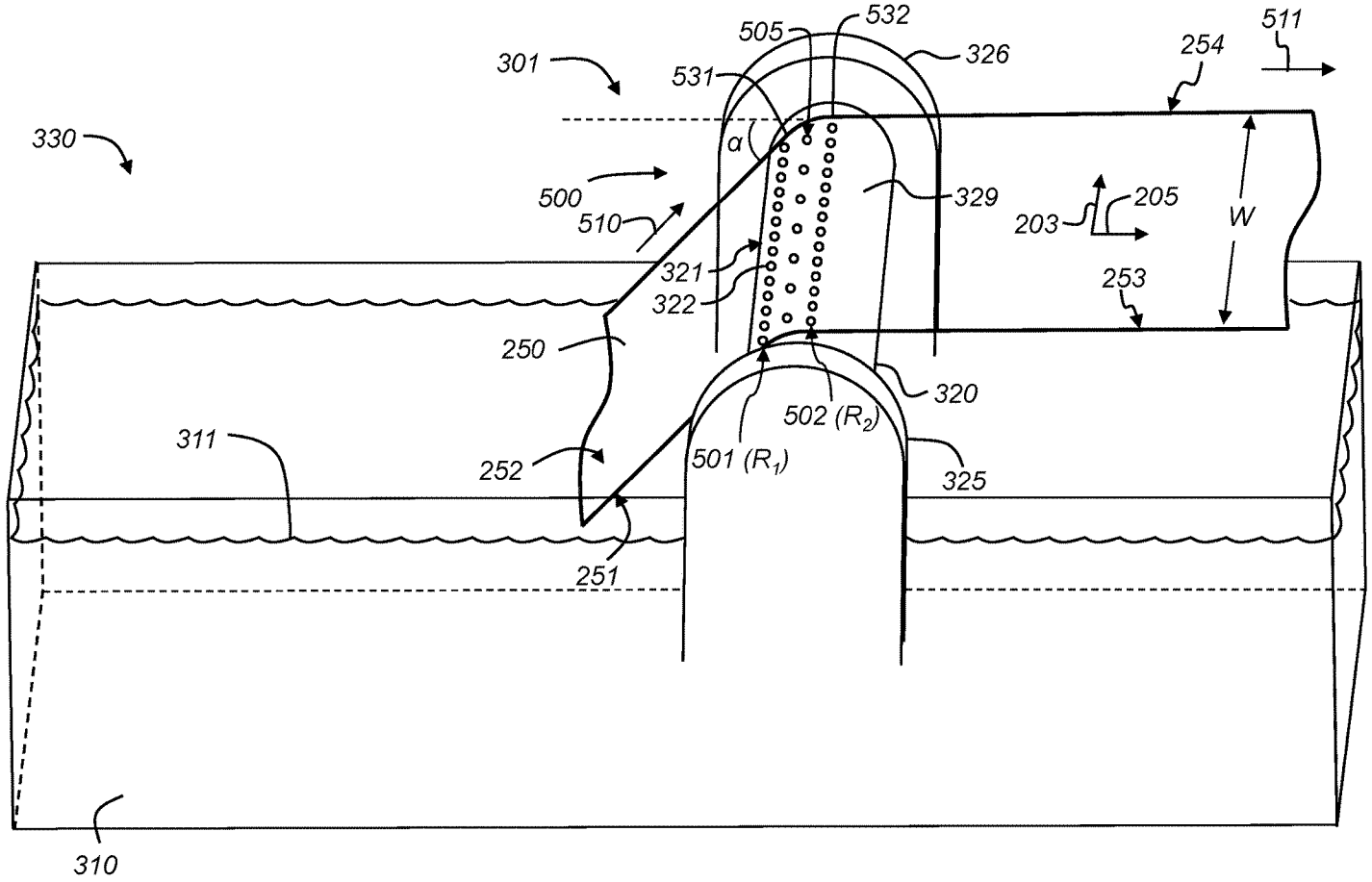
FIG. 5 shows a portion of a web of media being guided around the non-submerged non-contact web guide of FIG. 4.

FIG. 5 shows a shows a portion of a web transport system 301 in which a web of media 250 is guided in non-contact fashion along a web transport path 500 around and past the non-submerged web guide 320 of FIG. 4. The web of media 250 travels in an in-track direction 205 and extends widthwise in a cross-track direction 203 from a first edge 253 to a second edge 254 to define a width W. The web guide 320 spans the width of the web of media 250. The web of media 250 has a first surface 251 and an opposing second surface 252, where the first surface 251 faces the bearing surface 321 of the web guide 320. The bearing surface 321 is defined to be the portion of the exterior surface of the web guide 320 around which the web of media 250 is wrapped. As will be described in more detail below with reference to FIG. 6, the bearing surface 321 extends from a web guide entry position 531 to a web guide exit position 532.

The first array 501 of liquid ejection holes 322 is located in proximity to the web guide entry position 531, and the second array 502 of liquid ejection holes 322 is located in proximity to the web guide exit position 532. The liquid ejection holes 322 in the first array 501, the second array 502, and the intermediate array 505 are distributed across the web guide 320 in the cross-track direction 203. In the example shown in FIG. 5, the liquid ejection holes 322 of first array 501 are distributed as a linear array along a line spanning the web guide 320 in the cross-track direction 203 to form a first row $R_1$. Similarly, the liquid ejection holes 322 of second array 502 are distributed as a linear array along a line spanning the web guide 320 in the cross-track direction 203 to form a second row $R_2$. The optional intermediate array 505 includes additional liquid ejection holes 322 that are not located near either the web guide entry position 531 or the web guide exit position 532. In the exemplary configuration of FIG. 5, the liquid ejection holes 322 of the intermediate array 505 are distributed as a linear array along a line spanning the web guide 320 in the cross-track direction 203. In other embodiments, the liquid ejection holes 322 of the intermediate array 505 can be arranged along a plurality of lines or in some other configuration.

As the web of media 250 approaches the web guide 320 it is traveling in an input travel direction 510, and as the web of media 250 moves away from the web guide 320 it is traveling in an output travel direction 511. The angle between the input travel direction 510 and the output travel direction 511 defines a wrap angle a. As pressurized processing liquid 310 is pumped through the liquid ejection holes 322 in the bearing surface 321 into a region between the first surface 251 of the web of media 250 and the bearing surface 321 of the web guide 320, the web of media 250 is forced away from the web guide 320. This permits guiding of the web of media 250 without scratching it by contact with the web guide 320.

As shown schematically in FIG. 3, web guides in a web transport system 301 can have a variety of configurations. They can include non-submerged web guides 302 and submerged web guides 304, and can have a variety of different wrap angles. It has been found that preferred configurations of liquid ejection holes 322 can depend on variables such as these, as well as other variables including web tension, web stiffness, orientation of the bearing surface, and characteristics of the ejected liquid, as disclosed in the aforementioned U.S. patent application Ser. No. 15/158,716.

The web of media 250 does not touch the bearing surface 321, but is forced outward to a stand-off distance S (see FIG. 7) with respect to the bearing surface 321 by the pressurized liquid (e.g., processing liquid 310) that is pumped into the hollow interior 327 of web guide 320 and is ejected through the liquid ejection holes 322. The stand-off distance S is the gap between the web of media 250 and the bearing surface 321. The stand-off distance S is preferably large enough to prevent against contact between the web of media 250 and the bearing surface 321.

The web guide 320 of FIG. 5 has a wrap angle $\alpha$ of less than 90 degrees between the input travel direction 510 and the output travel direction 511. With reference also to FIG. 5, processing liquid 310 that is pressurized within the hollow interior of the web guide 320 is ejected through liquid ejection holes 322 of the first array 501, the second array 502, and the intermediate array 505. Web guide 320 has a curved wall 328 having a wall thickness T with a curved exterior surface 329 (see FIG. 7). Liquid ejection holes 322 are formed through the curved wall 328 from the hollow interior 327 to the curved exterior surface 329. All of the liquid ejection holes in this example have the same characteristic shape and size, but they can have different orientations relative to the curved wall 328. Although in general the hole diameter and the hole shape can vary from hole to hole and from array to array, in an exemplary configuration, the liquid ejection holes 322 are circular and have a diameter that is within 10% of a value which is referred to as the characteristic diameter D herein. It has been found to be advantageous if the ratio of the wall thickness T to the characteristic diameter D is between about 1.5 and 3.0. For example, in an embodiment where the wall thickness T was 3.0 mm, it was found that the best liquid bearing performance in terms of stand-off distance, total flow, and web stability was for a characteristic diameter D of about 1.5 mm (a ratio of 2.0). In other embodiments (not shown) the liquid ejection holes can have a non-circular shape, including shapes such as ovals or rectangular slots.

Figure 6:
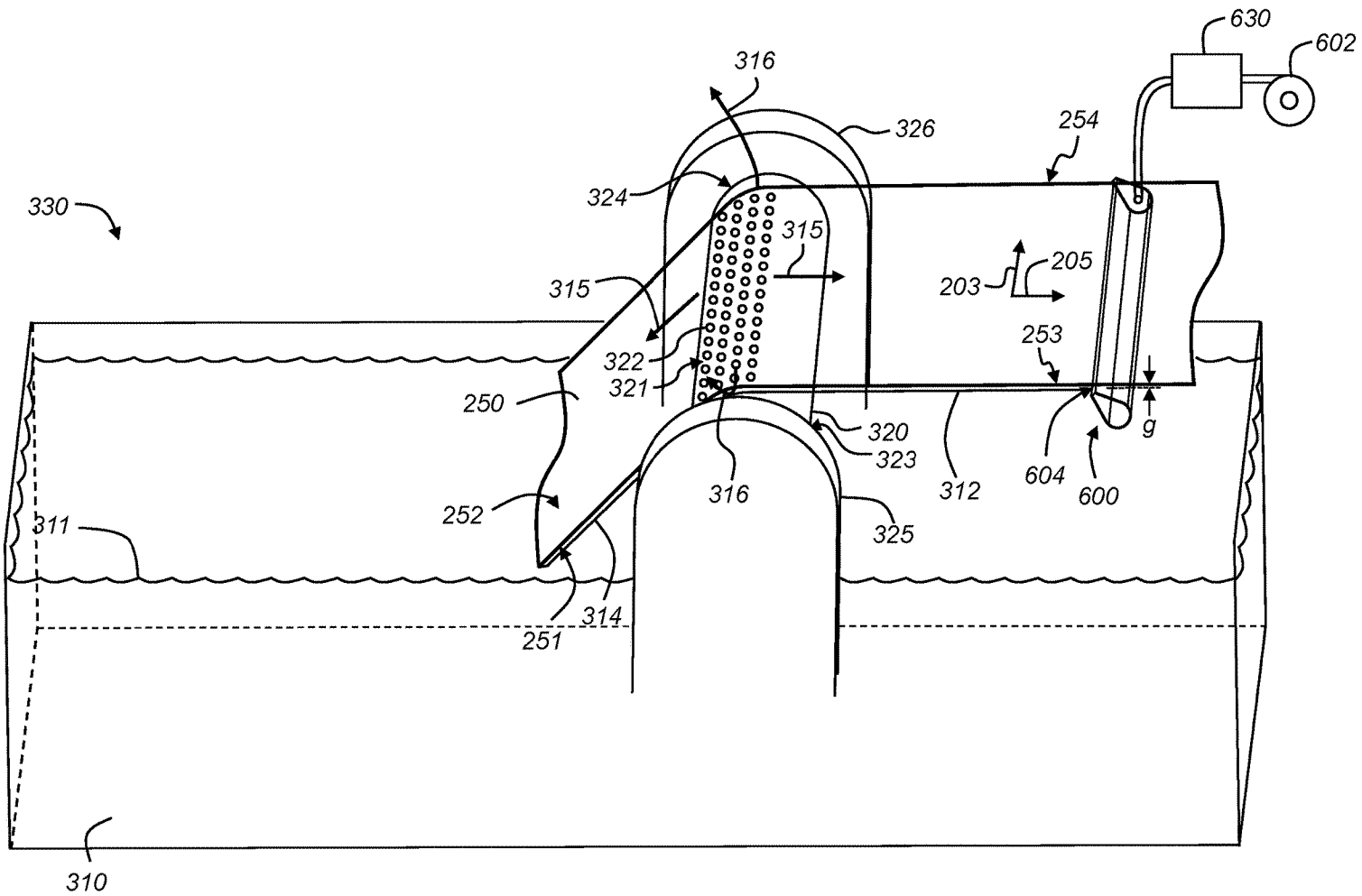
FIG. 6 shows a cutaway perspective of a processing tank including an air skive positioned downstream of a non-submerged web guide in accordance with the invention.
Figure 7:
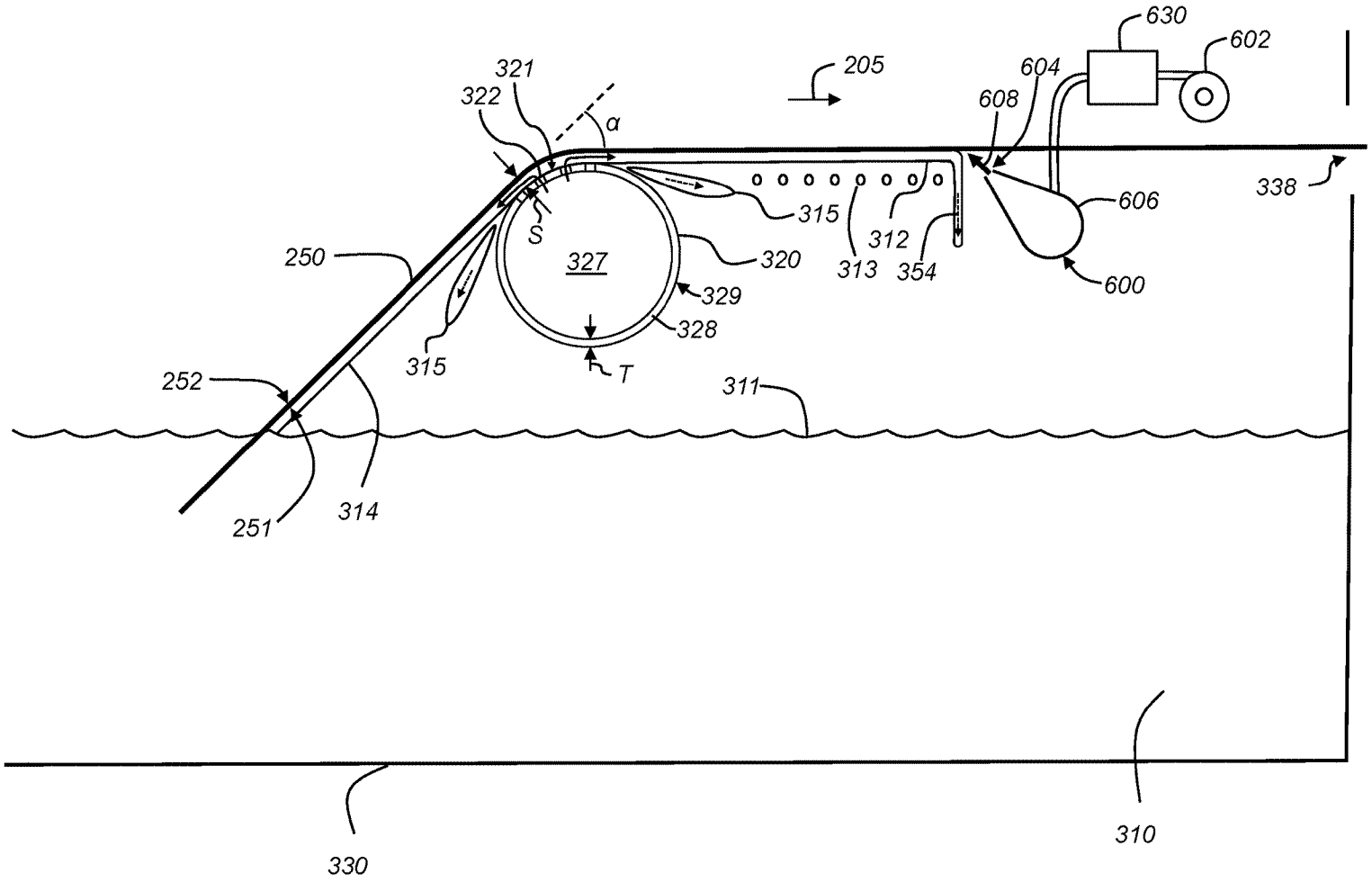
FIG. 7 shows a schematic side view of the processing tank of FIG. 6.

FIG. 6 is similar to FIG. 5 except that includes an air skive 600 that can be used to mitigate problems that can occur when ejecting a liquid processing solution through a non-submerged web guide 320. FIG. 7 illustrates a schematic side view of this configuration. The processing solution exits the regions between the web guide 320 and the web of media 250 as deflected liquid 315, 316. The deflected liquid 315 is deflected along the web of media 250 both upstream and downstream in terms of the direction of motion of the web of media 250. Some of the deflected liquid 315 forms a sheet of liquid 314 that is directed by the web of media 250 back into the processing liquid 310. In addition, some of the deflected liquid 315 forms a sheet of liquid 312 that adheres to first surface 251 of web of media 250 and is carried toward the exit 338 of processing tank 330. Some of the sheet of liquid 312 falls as drips 313 back into the processing liquid 310 in processing tank 330. However, in prior art configurations, a significant amount of processing liquid 310 in the sheet of liquid 312 can exit the processing tank 330 and be carried into downstream processing components. This wastes processing liquid 310, and also contaminates the solutions used in the subsequent processing operations. Although copper plating solution is moderately expensive, palladium plating solution is quite expensive, and any waste is unacceptable.

The exemplary configuration of FIG. 6 includes an air skive 600, which can also be called an air knife, an air dam, an air blower or an air curtain. The air skive 600 is disposed along the web-transport path downstream of the web guide 320 to prevent a large portion of the sheet of liquid 312 from exiting the processing tank 330. The air skive 600 receives air from an air source 602. In an exemplary configuration, the "air" supplied by the air source 602 is normal atmospheric air. In other configurations, the "air" can be some other gas, or can be a mixture of gasses. The air skive 600 includes an air ejection nozzle 604 that spans the web of media 250 in the cross-track direction 203, through which the supplied air is directed at the web of media 250 as a stream of air 608. The air skive 600 also includes a plenum 606 which evenly distributes the supplied air across the width of the nozzle 604. As illustrated in FIG. 7, the air skive 600 is oriented to direct a stream of air 608 at the web of media 250 such that it causes the sheet of liquid 312 to be detached from the web of media 250 and to fall back into the processing tank 330. In this way, the air skive 600 prevents a large fraction of the sheet of liquid 312 from being carried along with the moving web of media 250 out of the exit 338 of the processing tank 330.

As illustrated in FIG. 7, the non-submerged web guide 320 ejects liquid (represented by the flow arrows) through the holes 322 in the bearing surface 321, which are above the liquid level 311. The web guide 320 supports the web of media 250 without touching it as web of media 250 is guided out of the processing liquid 310. As the web of media 250 passes the web guide 320, a direction of travel of the web of media 250 is redirected by an angle $\alpha$, which is typically at least 10 degrees. The angle a will correspond to the wrap angle of the web of media 250 around the web guide 320. In the example of FIG. 7, the web of media 250 is redirected so that it travels in a substantially horizontal direction (i.e., to within about ±5° of horizontal) as it passes air skive 600.

In the illustration of FIG. 7, the web guide 320 is shown as having a cylindrical shape with a circular cross-section. However, in other cases the fluid bar can have other shapes. The bearing surface 321 will generally have a smoothly-varying profile, such as an arc of a circle or an ellipse. Other types of smoothly-varying profiles would include a curve corresponding to some other type of conic section or smoothly-varying function. Aside from the bearing surface 321 over which the web of media 250 rides, the other surfaces of the web guide 320 can have any shape (e.g., they can be flat surfaces).

The stream of air 608 diverts at least a portion of the liquid in the sheet of liquid 312 being carried along by the web of media 250 away from the first surface 251 of the web of media 250 such that the diverted portion of liquid flows down into the processing liquid 310 in the processing tank 330, as indicated by flow arrow 354. Furthermore, the body of the air skive 600, together with the stream of air 608 exiting the nozzle 604 of the air skive 600, serve to block any drips 313 of liquid as well as any deflected liquid 315 that is sprayed out from the region between the first surface 251 of the web of media 250 and the bearing surface 321 of the web guide 320, from reaching the portions of the web-transport path that are beyond the air skive 600.

The configuration illustrated in FIGS. 6-7 includes an air skive 600 positioned downstream of the web guide 320 in order to prevent processing liquid 310 from being carried downstream by the web of media 250 outside the processing tank 330, thereby preventing waste as well as contamination of the next tank. In other configurations, the air skive 600 can be positioned upstream of the web guide 320 in order to block deflected liquid 315 from travelling upstream along the web-transport path to a place where it can cause waste or adversely impact the liquid processing of the web of media 250 (see FIG. 8).

The use of air skives 600 have proved to be effective in removing the sheet of liquid 312 from the surfaces of the web of media 250. However, the removal of the liquid can be non-uniform, with some regions drying before other regions. This can lead to water spot related defects. It has been found that such defects can be eliminated or substantially reduced by the introduction of vapor into the air supplied by the air source 602 to the air skives 600. The vapor is added to the air stream by a vapor source 630. A vapor is the gaseous state of a substance that is normally liquid or solid at room temperature. In a preferred configuration, the vapor corresponds to the gaseous phase of the primary solvent in the processing liquid 310. As the processing liquid 310 is typically water based, in this case the preferred vapor is water vapor. The presence of the vapor in the air provided by the air skive 600 enables the majority of the liquid to be removed from the surface of the web of media 250 while preventing the surface from being fully dried. This has been found to substantially decrease the formation of drying artifacts. Further details regarding various embodiments of the vapor source 630 will be discussed later with respect to FIGS. 12-14.

Figure 8:
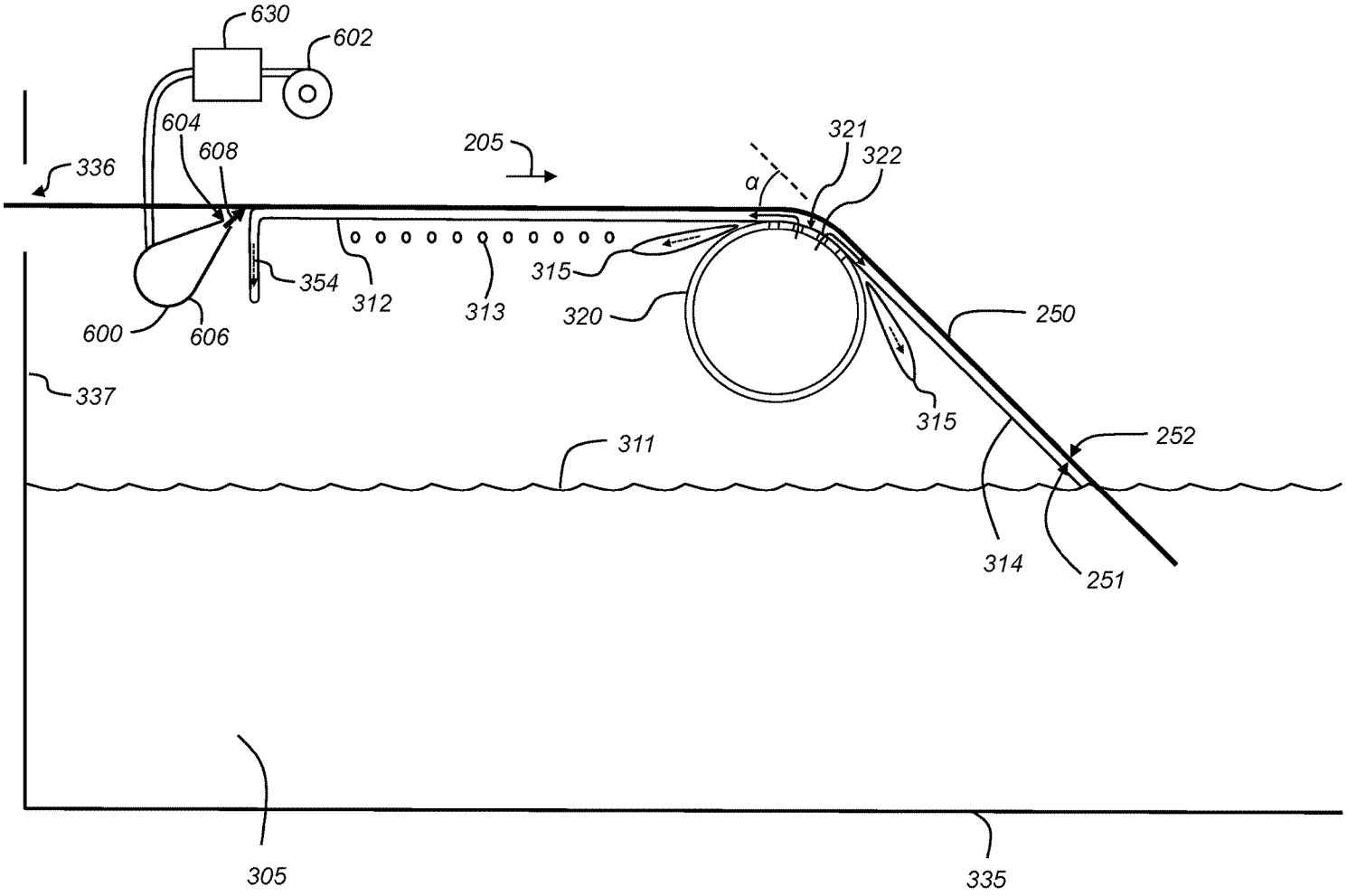
FIG. 8 shows a schematic side view of a processing tank with an air skive positioned upstream of a non-submerged web guide.

An alternate configuration is shown in the schematic side view of FIG. 8 in which the non-submerged web guide 320 is positioned near the entrance 336 of a processing tank 335, and the web guide 320 guides the web of media 250 from a substantially horizontal entry orientation to proceed into the processing liquid 305. For example, the tank can be processing tank 335 of FIG. 3, and the processing liquid 305 can be water.

As the processing liquid 305 is ejected through the bearing surface 321 of the web guide 320, a sheet of liquid 314 is directed downstream along the web of media 250 and back into the reservoir of processing liquid 305. In this case, the sheet of liquid 314 does not travel to a place where it can cause waste or adversely impact the liquid processing of the web of media 250. There is therefore no need to remove the sheet of liquid 314 from the surface of the web of media 250. However, a second sheet of liquid 312 is directed upstream along the web of media 250 toward the entrance 336 of processing tank 335. Even though the web of media 250 is moving in the in-track direction 205, the velocity of sheet of liquid 312 in the opposite direction is typically much higher than the web velocity. An air skive 600 can be positioned near the entrance 336 of the processing tank 335 to prevent processing liquid 305 from spraying onto the entrance wall 337 of the processing tank 335 or passing through the entrance 336 into upstream portions of the processing path (e.g., into processing tank 330 of FIG. 3). Allowing processing liquid 305 to pass through the entrance 336 would be undesirable, as it would cause the adverse effect of diluting the processing liquid 310 in the previous processing tank 330.

The air skive 600 serves to reduce the amount of processing liquid 305 that travels to portions of the web-transport path that are upstream of the air skive 600. Comparing FIGS. 7 and 8, it can be seen that the air skive 600 in FIG. 8 is oriented in an opposite orientation from the air skive 600 in FIG. 7. Some guidelines for the position and orientation of the air skive 600 are that: a) the air skive 600 should be positioned downstream (in terms of web motion) of the web guide 320 if liquid directed in the downstream direction would cause waste or adverse effects; b) the air skive 600 should be positioned upstream (in terms of web motion) of the web guide 320 if liquid directed in the upstream direction would cause waste or adverse effects; and c) the orientation of the air skive 600 should preferably be such that the stream of air 608 is directed onto the surface of the web of media 250 and is tilted toward the web guide 320.

A web guide 320 and a corresponding air skive 600 located near the entrance 336 of a processing tank 335, as in the example of FIG. 8, can be referred to as an "input fluid bar" and an "input air skive," respectively. A web guide 320 and a corresponding air skive 600 located near the exit 338 from a liquid processing tank 330, as in the example of FIG. 7, can be called an "exit fluid bar" and an "exit air skive," respectively.

In some configurations, the arrangements of FIGS. 7 and 8 can be combined to keep liquid from escaping from a processing tank 330 in either the upstream or downstream directions. The arrangement of FIG. 8 with its input web guide 320 and input air skive 600 can be used at the entrance 336 to the processing tank 330, and the arrangement of FIG. 7 with its exit web guide 320 and exit air skive 600 can be used at the exit from the same processing tank 330.

Elements of such a web transport system can be described as follows. An input web guide 320 (as in FIG. 8) is disposed along the web-transport path upstream of the position where the web of media 250 enters the processing liquid 310 (e.g., a plating solution) in the processing tank 330. The input web guide 320 redirects the web of media 250 toward the processing liquid 310 as it passes the input web guide 320 with a first surface 251 of the web of media 250 facing an exterior bearing surface 321 of the input web guide 320. The processing liquid 310 is pumped through holes 322 in the bearing surface 321 of the input web guide 320 and into a region between the first surface 251 of the web of media 250 and the bearing surface 321 of the input web guide 320, thereby pushing the web of media 250 away from the input web guide 320. An input air skive 600 is disposed along the web-transport path upstream of the input web guide 320 and spans the web of media 250 in a cross-track direction 203 (see FIG. 6). The input air skive 600 includes a nozzle 604 facing the first surface 251 of the web of media 250, the nozzle 604 being spaced apart from the first surface 251 of the web of media 250 by a gap distance. The input air skive 600 removes at least some processing liquid 310 that flows out from the region between the first surface 251 of the web of media 250 and the bearing surface 321 of the input web guide 320, thereby preventing it from reaching portions of the web-transport path that are upstream of the input air skive 600.

In addition, an exit web guide 320 (as in FIG. 7) is disposed along the web-transport path downstream of the position where the web of media 250 exits processing liquid 310 in the processing tank 330. (Note that the geometries of the entrance and exit fluid bars 320 may or may not be the same.) The exit web guide 320 redirects the web of media 250 as it passes the exit web guide 320 with the first surface 251 of the web of media 250 facing an exterior bearing surface 321 of the exit web guide 320. Processing liquid 310 is pumped through holes 322 in the bearing surface 321 of the exit web guide 320 and into a region between the first surface 251 of the web of media 250 and the bearing surface 321 of the exit web guide 320, thereby pushing the web of media 250 away from the exit web guide 320. An exit air skive 600 is disposed along the web-transport path downstream of the exit web guide 320 and spans the web of media 250 in the cross-track direction 203. The exit air skive 600 includes a nozzle 604 facing the first surface 251 of the web of media 250, the nozzle 604 being spaced apart from the first surface 251 of the web of media 250 by a gap distance. (Note that the geometries of the entrance and exit air skives 600 and the corresponding gap distances may or may not be the same.) The exit air skive 600 removes at least some of the processing liquid 310 from the first surface 251 of the web of media 250 as it passes by the exit air skive 600, thereby reducing the amount of processing liquid 310 that is carried along to portions of the web-transport path that are downstream of the exit air skive 600.

Figure 9:
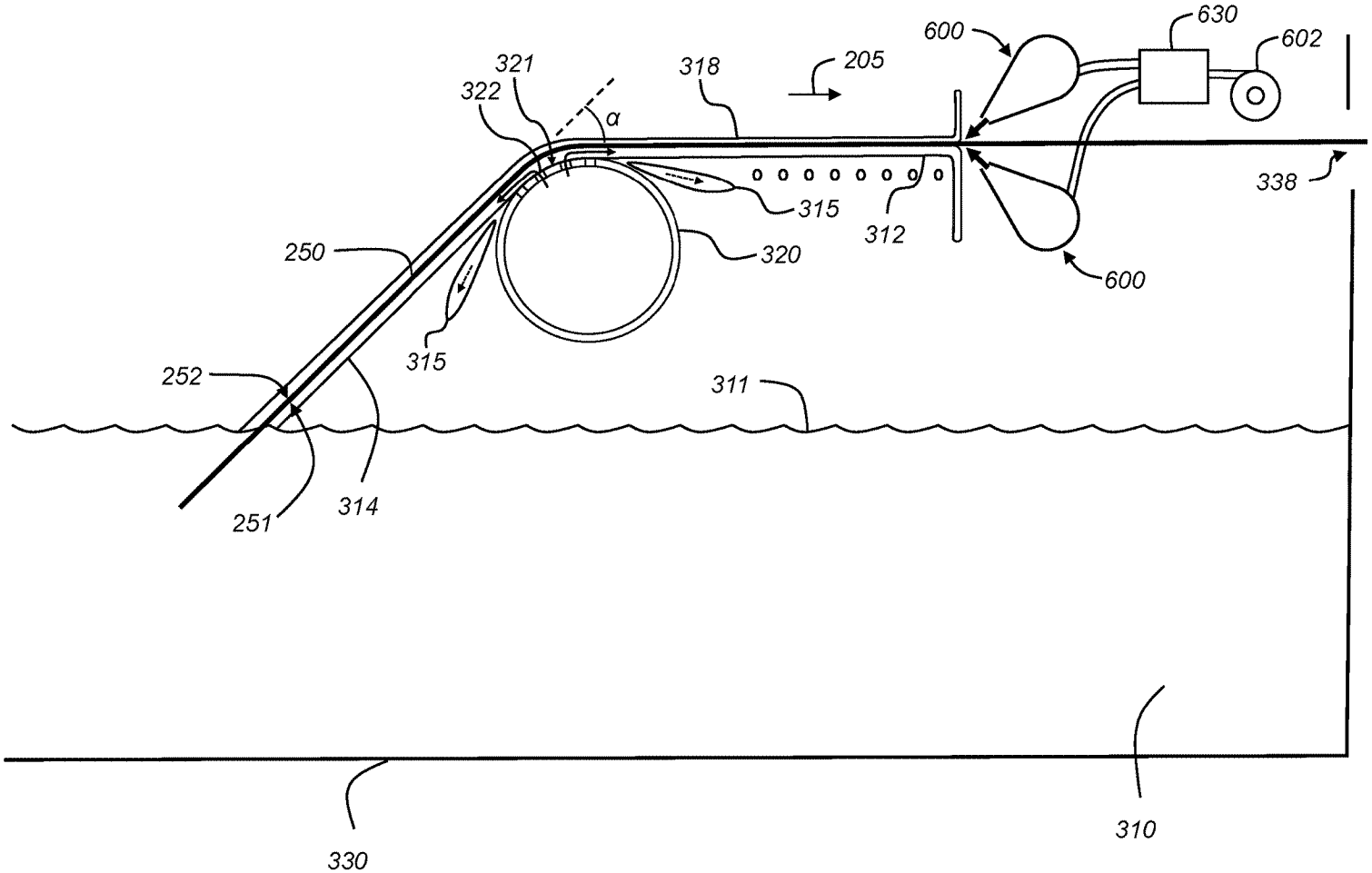
FIG. 9 shows a schematic side view of a processing tank with air skives adjacent to both surfaces of the web of media.

The air skives 600 of FIGS. 6-8 are positioned adjacent to the first side 251 of the web of media 250, which is the side of the web of media adjacent to the non-submerged liquid bar 320. In this position, the air skive 600 is effective in removing substantially all the corresponding sheet of liquid 312, 314 on the first side 251 of the web of media 250. However, as the web of media 250 is withdrawn from the processing liquid 310, some processing liquid 310 will typically be entrained on the second surface 252 of the moving web of media 250 as well. This entrained liquid 318 can be removed from the second surface 252 by an additional air skive 600 positioned adjacent to the second surface 252 of the media as illustrated in FIG. 9. Preferably, the air supplied to the second air skive 600 by the air source 602 also includes a vapor supplied by a vapor source 630. In the illustrated exemplary configuration, both air skives 600 receive air from the same air source 602 and the same vapor source 630. In alternate configurations, separate air sources 602 and vapor sources 630 can be used for each air skive 600.

Figure 10:
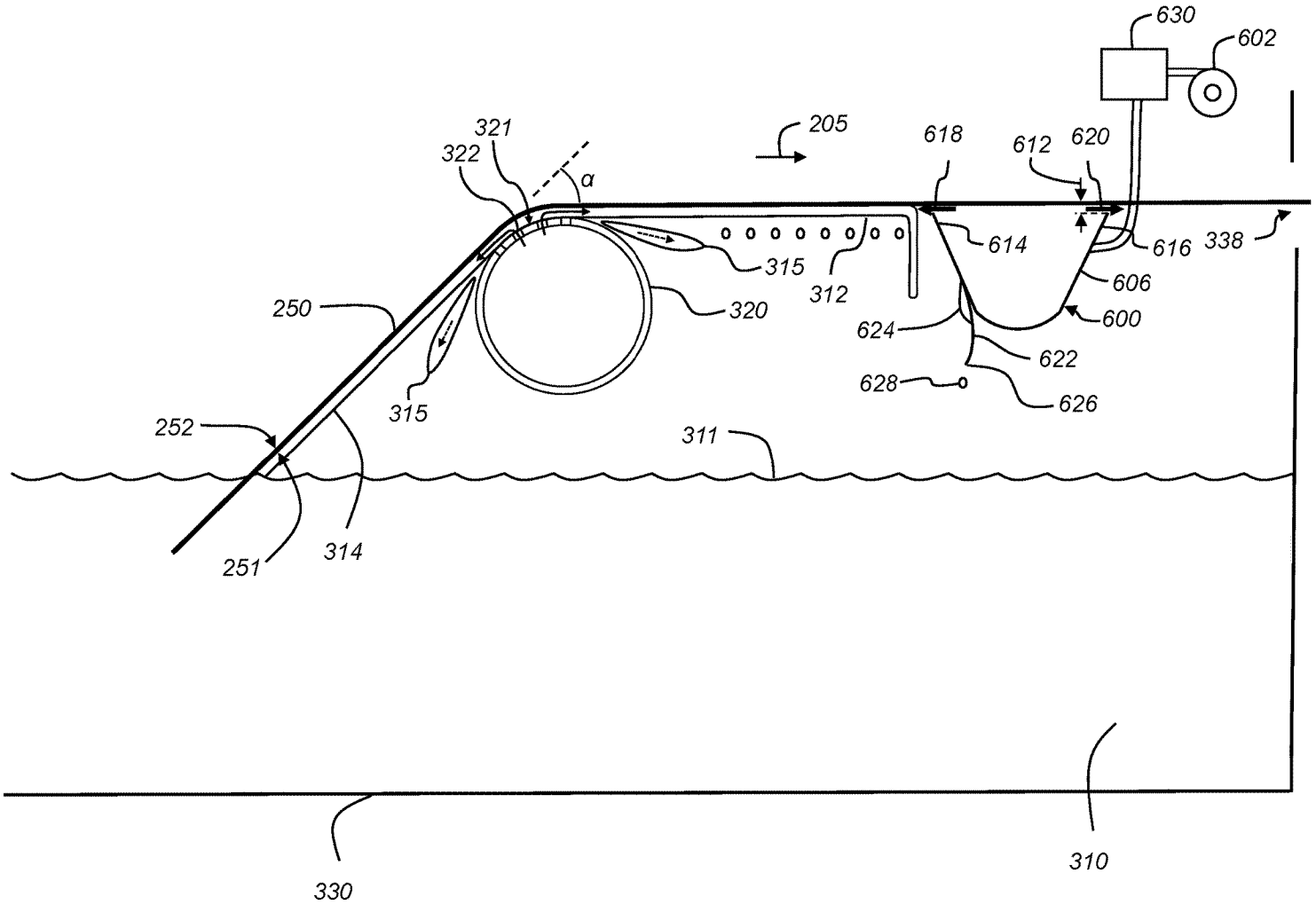
FIG. 10 shows a schematic side view of a processing tank including an alternate air skive configuration positioned downstream of a non-submerged web guide.

While the air skives 600 of FIGS. 6-9 are configured to have a narrow nozzle 604 through which a narrow stream of air 608 is directed at the web of media 250 to displace liquid from the surface of the web of media 250, other configurations of air skives 600 can also be employed. In FIG. 10, the air skive 600 comprises a plenum 606 having a large opening facing the web of media 250 through which a wide stream of air is directed at the web of media 250. The air supplied to the air skive 600 by the air source 602 and vapor source 630 must exit the enclosure formed by the walls of the plenum 606 and the adjacent surface of the web of media 250 by flowing out through the gap 612 between the web of media 250 and the upstream edge 614 and the downstream edge 616 of the plenum 606 to form an upstream stream of air 618 in an upstream direction and a downstream stream of air 620 in a downstream direction.

The upstream stream of air 618 will displace the sheet of liquid 312 from the web of media 250 so that the liquid falls back into the processing tank 330. A portion of the liquid displaced from the web of media 250 by the upstream stream of air 618 from the air skive 600 can contact and attach to the exterior surface of the air skive 600. In some configurations, the exterior surface of the air skive 600 can include a flow diverter 622 configured to alter the flow path of the attached liquid 624 directing the attached liquid 624 back toward the processing tank 330. The flow diverter 622 can include a sharp terminating edge 626 to increase the potential for the attached liquid 624 to detach from the flow diverter 622 at the terminating edge 626 as drops 628, and to fall back into the processing tank 330.

Figure 11:
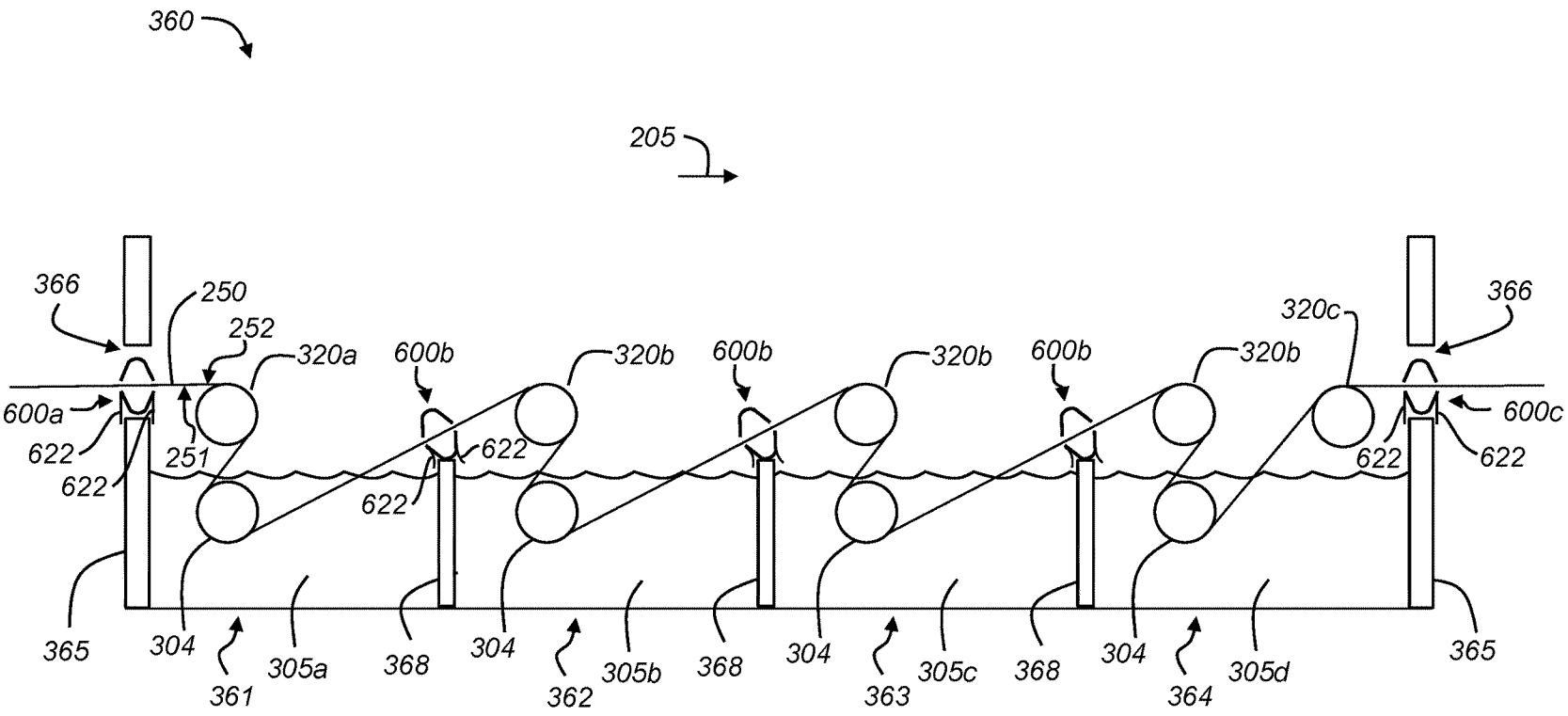
FIG. 11 shows a four-stage processing tank with associated non-submerged web guides and air skives.

The air skive of FIG. 10, produces both an upstream stream of air 618 in an upstream direction and a downstream stream of air 620 in a downstream direction. As a result, it is well-suited to use in systems where sheets of liquid are moving along the web of media 250 in both an upstream direction and a downstream direction at a particular point along the web-transport path. An example of this is shown in FIG. 11 in which a four-stage processing tank 360 includes a series of non-submerged web guides 320*a*, 320*b*, 320*c* (e.g., fluid bars), and a series of air skives 600*a*, 600*b*, 600*c*, positioned along a web-transport path that passes through a series of individual processing tanks 361, 362, 363, 364. In an exemplary configuration, the four-stage processing tank 360 is a rinse tank that follows a plating tank (e.g., processing tanks 330, 340 of FIG. 3).

The four-stage processing tank 360 includes a first stage processing tank 361, a second stage processing tank 362, a third stage processing tank 363 and a fourth stage processing tank 364, which are bounded by end walls 365 and partitions 368. In an exemplary configuration, the processing liquids 305*a*, 305*b*, 305*c*, 305*d* using in the four processing tanks 361, 362, 363, 364 is water. However, other rinse solutions (or processing solutions) can also be used in other configurations. As residues of plating solution, for example, are rinsed from web of media 250, processing liquid 305*a* in first processing tanks 361 becomes the most contaminated with residue, with the level of contamination being less for each successive processing tank 362, 363, 364. It is not desirable for the processing liquids 305*a*, 305*b*, 305*c*, 305*d* to be carried either upstream into the previous stage or downstream into the next stage.

The web of media 250 enters the four-stage processing tank 360 through an opening 366 in the upstream end wall 365 and moves along the in-track direction 205. It is guided around a non-submerged input web guide 320*a* to enter processing liquid 305*a*. In addition to preventing contact between the web of media 250 and the web guide 320*a*, the processing liquid (e.g., water) ejected by the web guide 320*a* against the first surface 251 of web of media 250 assists in rinsing the first surface 251 of the web of media 250. Likewise, processing liquid ejected by submerged web guide 304 against the second surface 252 of web of media 250 assists in rinsing the second surface 252. The same is true for each subsequent stage.

After passing around the submerged web guide 304 in the first processing tank 361, the web of media 250 passes out of the processing liquid 305*a* and is guided by non-submerged intermediate web guide 320*b* to enter the processing liquid 305*b* of the second processing tank 362. Similarly, after passing around the submerged web guide 304 in the second processing tank 362, the web of media 250 passes out of the processing liquid 305*b* and is guided by non-submerged intermediate web guide 320*b* to enter the processing liquid 305*c* of the third processing tank 363, and after passing around the submerged web guide 304 in the third processing tank 362, the web of media 250 passes out of the processing liquid 305*c* and is guided by non-submerged intermediate web guide 320*b* to enter the processing liquid 305*d* of the fourth processing tank 364. Finally, the web of media 250 is guided out of the four-stage processing tank 360 by non-submerged exit web guide 320*c* through opening 366 in the downstream end wall 365.

Air skives 600*a*, 600*b*, 600*c* are positioned in proximity to the end walls 365 and each of the partitions 368 in order to reduce contamination between the stages, as well as contamination flowing toward previous or subsequent portions of the processing path. For example, processing liquid ejected from the input web guide 320*a* flows both toward the opening 366 in the upstream end wall 365 and also into the first processing tank 361. Processing liquid flowing into the reservoir of processing liquid 305*a* is not a problem, but processing liquid 305*a* flowing toward opening 366 in end wall 365 can cause waste as well as contamination of a previous tank. Input air skive 600*a* is positioned upstream of non-submerged input web guide 320*a*, and is similar to the configuration of FIG. 10 except that it includes two air skive units, one positioned adjacent to the first surface 251 and another positioned adjacent to the second surface 252 of the web of media 250. In this case, the input air skive 600*a* includes both upstream-side and downstream-side flow diverters 622 straddling the end wall 365. The downstream-side flow diverter 622 ensures that liquid that is removed from the web of media by the air skive 600*a* is guided back into the reservoir of processing liquid 305*a* in the first processing tank 361. The upstream-side flow diverter 622 ensures that any liquid approaching the air skive 600*a* from the upstream side that is detached from the web of media 250 and directed back into the upstream processing tank (not shown in FIG. 11).

The configurations of the non-submerged intermediate web guides 320*b* associated with the second processing tank 362, the third processing tank 363 and the fourth processing tank 364 are similar to the non-submerged input web guide 320*a*, such that liquid ejected by the intermediate web guides 320*b* in the upstream direction is directed back into the same processing tank 305*a*, 305*b*, 305*c*, 305*d* that it came from. Without having the intermediate air skives 600*b* positioned upstream of the intermediate web guides 320*b*, liquid ejected toward the upstream direction would tend to flow back into the previous stage. Additionally, the intermediate air skives 600*b* also prevent liquid entrained by the moving web of media 250 as it exits the processing liquid 305*a*, 306*b*, 306*c* of one of the stages from travelling downstream into the next processing tank 362, 363, 364.

In the example shown in FIG. 11, the web of media 250 is inclined upward toward the intermediate fluid bars 320*b*. The corresponding upstream intermediate air skives 600*b* are oriented parallel to the inclined web of media 250 so that the upstream and downstream gaps are approximately equal. Liquid flowing down the inclined web of media 250 from the downstream non-submerged web guide 320*b* is detached from the web of media 250 by the downstream stream of air 620 (see FIG. 11) exiting the air skive 600*b* in the downstream direction. Downstream flow diverters 622 ensure that the detached liquid flows back into the reservoir below the non-submerged web guide 320*b*. Entrained liquid being carried along with the web of media 250 is detached from the web of media 250 by the upstream stream of air 618 (see FIG. 11) exiting the air skive 600*b* in the upstream direction. Upstream side flow diverters ensure that the detached liquid flows back into the reservoir from which it came rather than being carried into the next stage.

The non-submerged exit web guide 320*c* redirects the web of media 250 exiting the processing liquid 305*d* in the fourth processing tank 364 out the opening 366 in the downstream end wall 365. Liquid ejected from the non-submerged exit web guide 320*c* in the upstream direction will flow back into the reservoir of processing liquid 305*d* in the fourth processing tank 364. However, liquid ejected in the downstream direction would tend to be carried beyond the end wall 365. Exit air skive 600*c* is positioned downstream of the exit web guide 320*c*, and is oriented similar to the example of FIG. 10. In this case, the exit air skive 600*c* is positioned to straddle the end wall 365. The liquid detached by the stream of air from the exit air skive 600*b* is directed back into reservoir of processing liquid 305*d* in the fourth processing tank 364. The upstream flow diverter 622 of the exit air skive 600*c* helps to ensure that the detached fluid flows into the reservoir of processing liquid 305*d* in the fourth stage 364.

Figure 12:
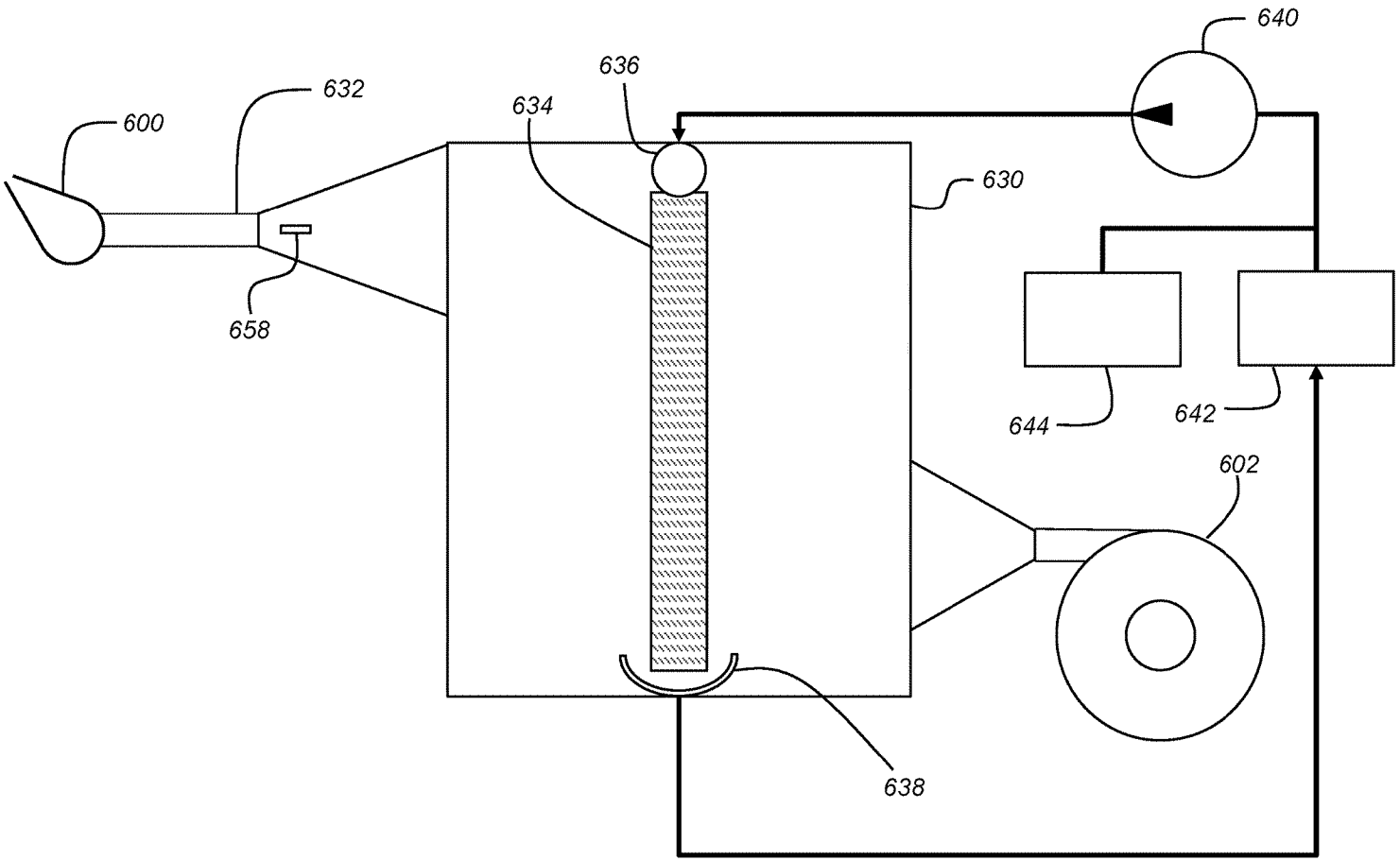
FIG. 12 shows a schematic of an embodiment of a vapor source positioned between an air source and an air skive.

As mentioned earlier, the use of a vapor source 630 to add vapor to the air provided by the air source 602 can be valuable for preventing artifacts resulting from non-uniform drying of the web of media 250. As is illustrated in FIG. 12, the vapor source 630 can be positioned in an air duct 632 between the air source 602 and the air skive 600. While the addition of vapor into the air stream can be done upstream of the air source 602, positioning the vapor source 630 downstream of the air source 602 is typically preferred. When the vapor source 630 is positioned downstream of the air source 602, the added moisture can help to reduce the temperature of the air stream provided by the air source 302. This will further reduce drying artifacts by reducing the evaporation rate of liquid from the surface of the web of media 250. Placement of the vapor source 630 downstream of the air source 602 also reduces the risk that constant high humidity levels might pose to the reliability of the air source 602. Ideally the vapor source 630 is positioned sufficiently upstream of the air skive 600 in the air duct 632 so that as the air through the air duct 632 downstream of the vapor source 630 can homogenize the vapor levels in the air stream before entering the air skive 600.

The vapor source 630 can take many forms. For example, FIG. 12 illustrates a vapor source 630 in which air supplied by the air source 602 passes through a moistened wicking material 634. In the illustrated exemplary configuration, liquid for moistening the wicking material 634 is provided by a liquid conduit 636 that has nozzles or pores (not shown) through which liquid can flow or drip onto the wicking material 634. The liquid can wick throughout the wicking material 634, from which the liquid can evaporate to form vapor that is carried out of the vapor source 630 by the supplied air flow. Any excess liquid can drip out of the wicking material 634 into a collection pan 638. The liquid collected by the collection pan 638 can be sent to waste, or it can be reconditioned by conditioning unit 642 and being pumped by pump 640 back to the liquid conduit 636. The conditioning by the conditioning unit 642 can include filtering, sterilizing, and demineralizing of the liquid. Additional liquid to make up for the evaporated liquid can be provided by a reservoir 644.

A sensor 658 can be included in one of the air skive 600, the vapor source 630, or the air duct 632 between the vapor source 630 and the air skive 600 to monitor one or more of the following: vapor levels (e.g., the relative humidity), temperature, air pressure, and air velocity. A controller (not shown) can receive the output of the sensor 658 and can control one or more control parameters related to the air source 602, vapor source 630 or air skive 600 in response to the output from the sensor. For example, the controller can control the rate at which liquid is supplied to the wicking material 634 of the vapor source 630 in response to the measured vapor levels in the air stream.

Figure 13:
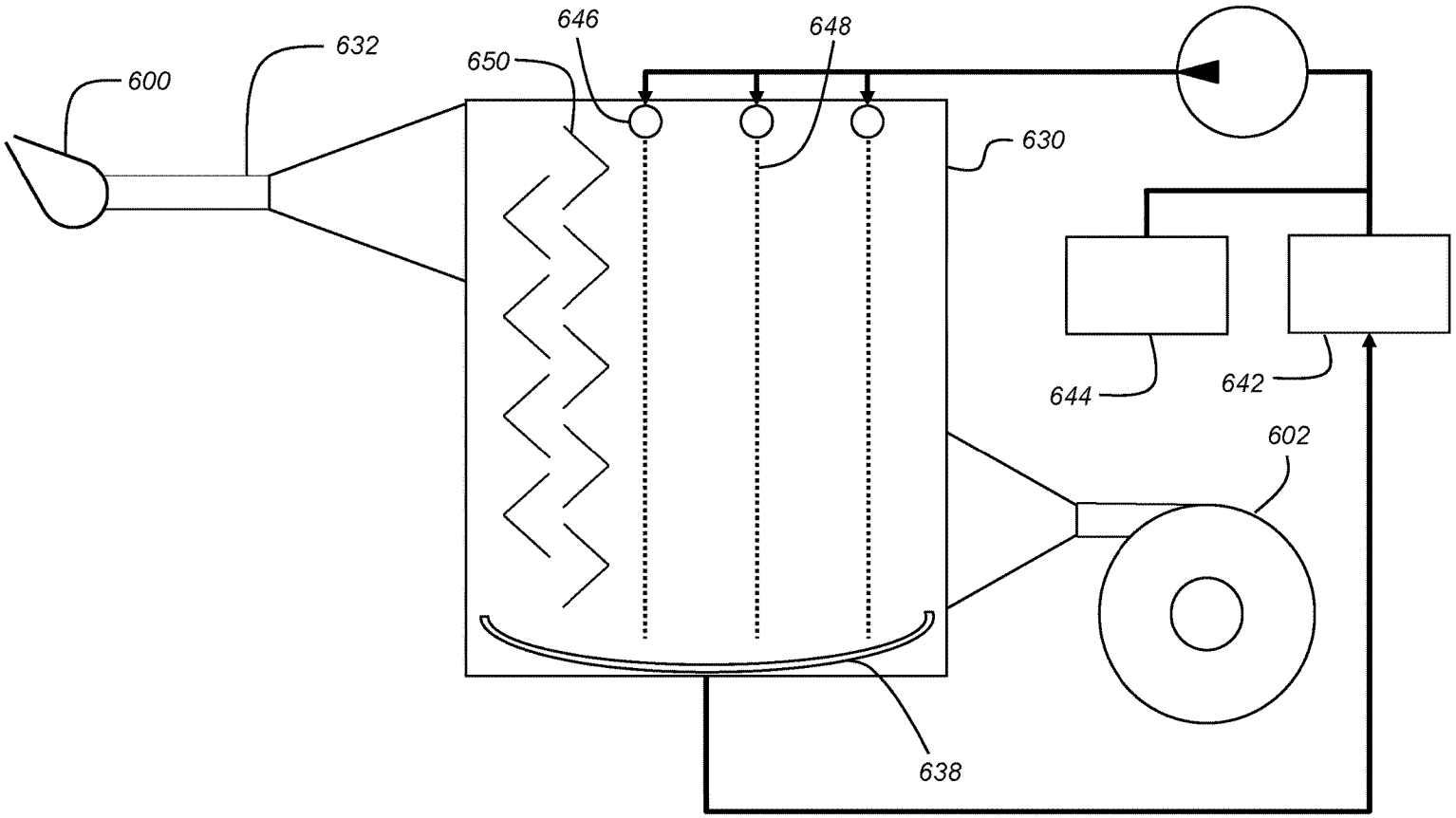
FIG. 13 shows a schematic of an alternate embodiment of a vapor source positioned between an air source and an air skive.

FIG. 13 shows another embodiment of a vapor source 630, in which liquid is sprayed from one or more atomizers 646 to create a fine mist 648 of liquid droplets. As the supplied air passes through the vapor source 630, the fine droplets in the mist 648 evaporate to add vapor to the flow of air. The vapor source 630 can include baffles 650 to prevent liquid droplets in the mist 648 from being entrained by the airflow and carried into the air skives 600.

Figure 14:
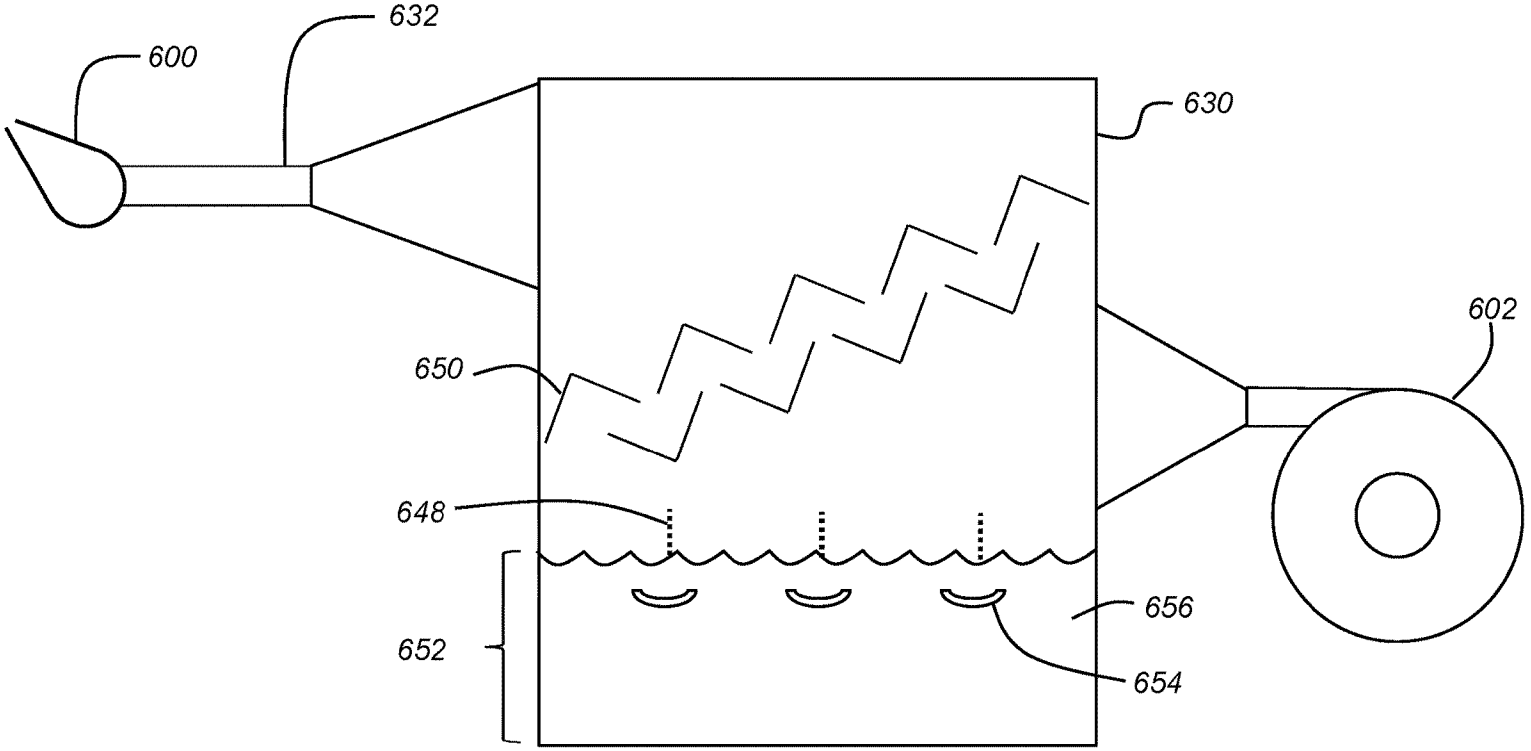
FIG. 14 shows a schematic of another alternate embodiment of a vapor source positioned between an air source and an air skive.

FIG. 14 illustrates another embodiment of a vapor source 630. The vapor source 630 includes an open reservoir 652 containing liquid 656. Immersed in the liquid 656 are one or more ultrasonic transducers 654, which emit ultrasonic energy that is brought to a focus near the surface of the liquid 656. The focused ultrasonic energy causes fine droplets of liquid to be ejected from the surface of the liquid to form a fine mist 648. As the supplied air passes through the vapor source 630, the fine droplets in the mist 648 evaporate to add vapor to the flow of air. The vapor source 630 can include baffles 650 to prevent the liquid drops in the mist 648 from being entrained by the airflow and carried through the air duct 632 into the air skive 600. The liquid 656 in the reservoir 652 can be recirculated and reconditioned in a similar manner to the other described vapor sources 630 of FIGS. 12-13.

Figure 15:
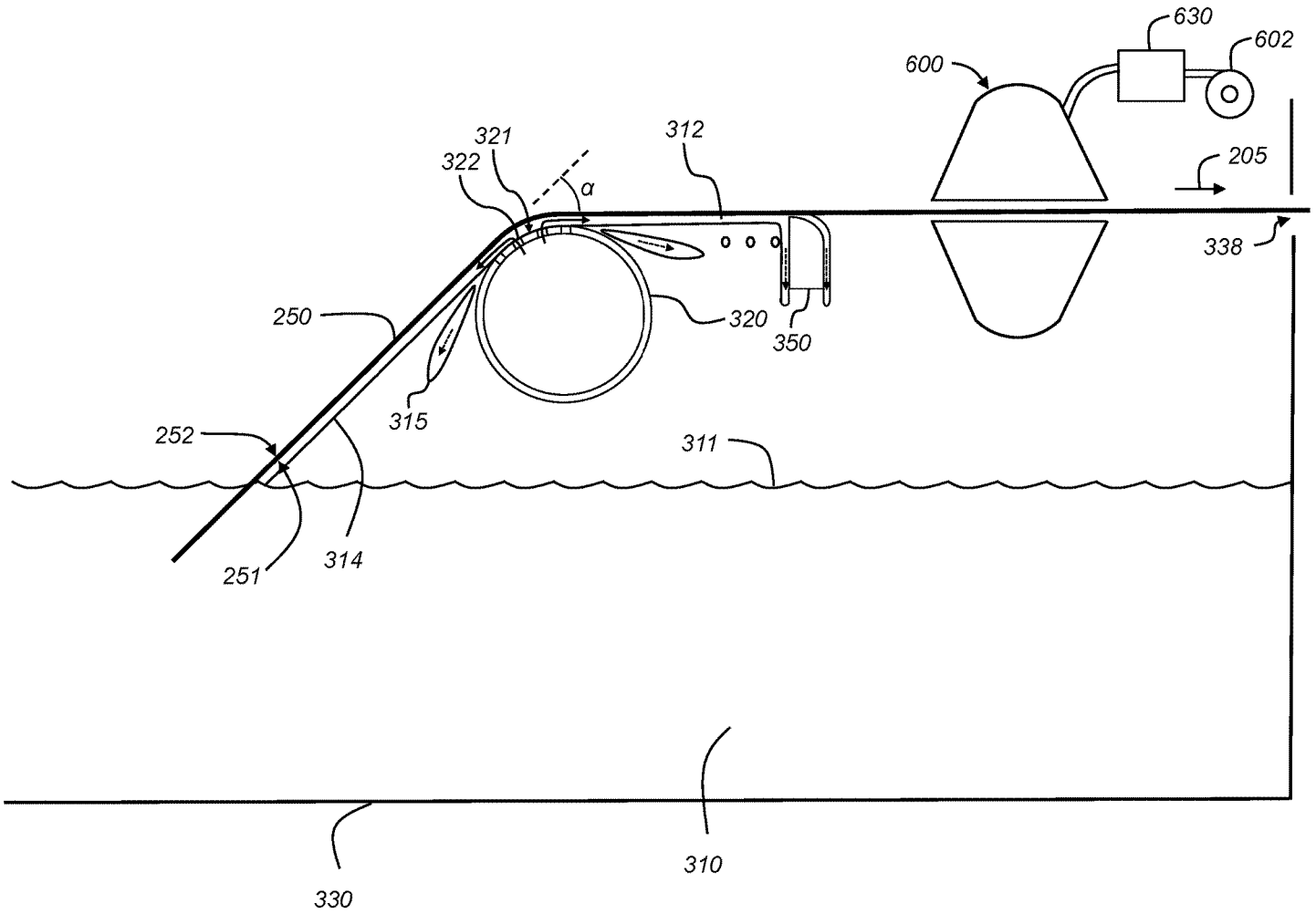
FIG. 15 shows a schematic side view of a processing tank including an air skive positioned downstream of a non-submerged web guide and a scavenger blade.

The air skives 600 can be used to remove sheets of liquid 312, 314 and entrained liquid 318 from the surfaces of the web of media 250, as was discussed with respect to FIGS. 6-11. In some configurations, air skives 600 can also can be used in conjunction with scavenger blades 350 as illustrated in FIG. 15. In an exemplary configuration, the scavenger blades 350 are those described in the aforementioned U.S. patent application Ser. No. 14/812,078 to Hill et al. In the illustrated configuration, a scavenger blade 350 is positioned between the non-submerged web guide 320 and the downstream air skive 600 to remove a significant portion of the sheet of liquid 312 from the surface of the web of media 250 prior to the web of media 250 arriving at the air skive 600. The use of the scavenger blade 350 upstream of the air skive allows the air skive to operate at lower air flow rates while still being effective at removing the liquid layer from the surface of the web of media.

Figure 16:
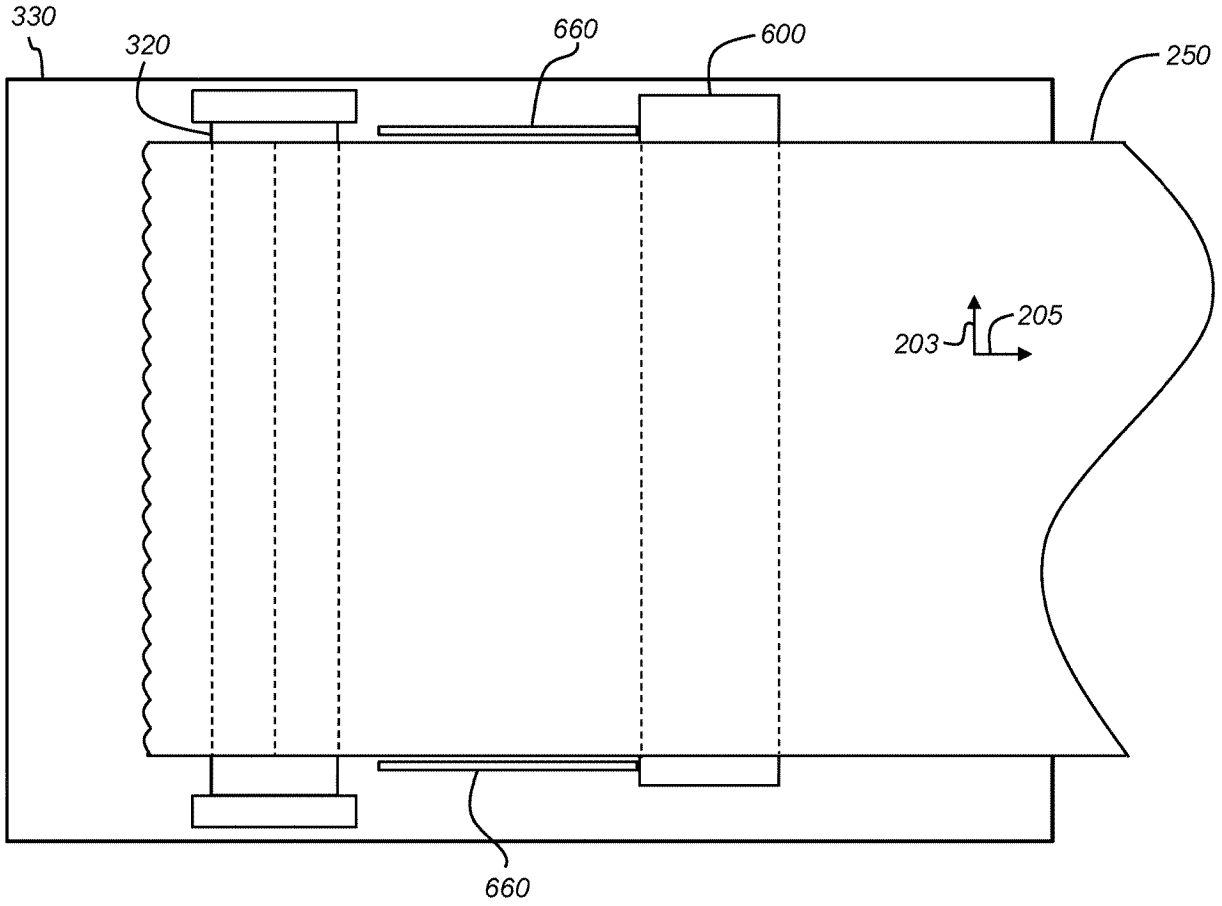
FIG. 16 shows a schematic top view of a processing tank including an air skive positioned downstream of a non-submerged web guide.
Figure 17:
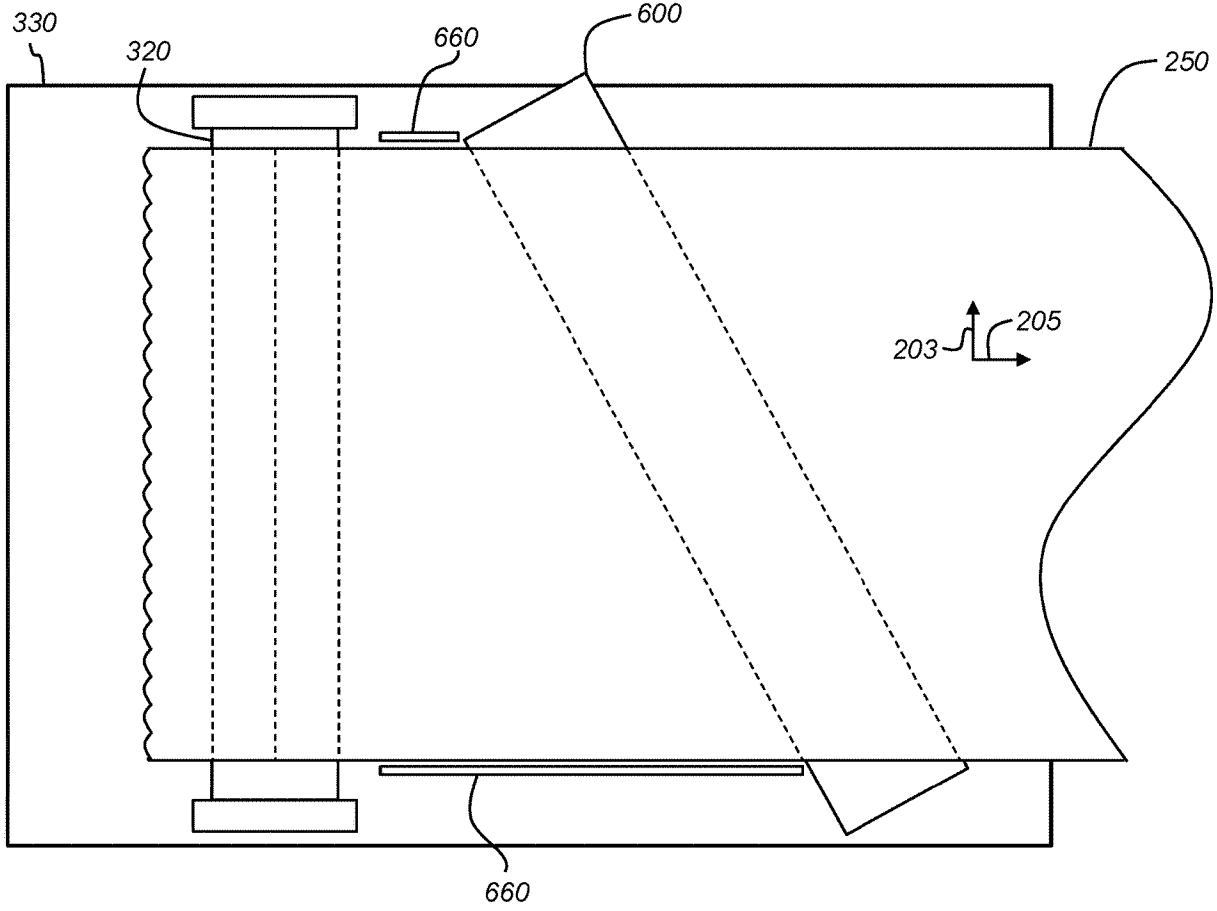
FIG. 17 shows a schematic top view of a processing tank including an air skive with an oblique orientation.
Figure 18:
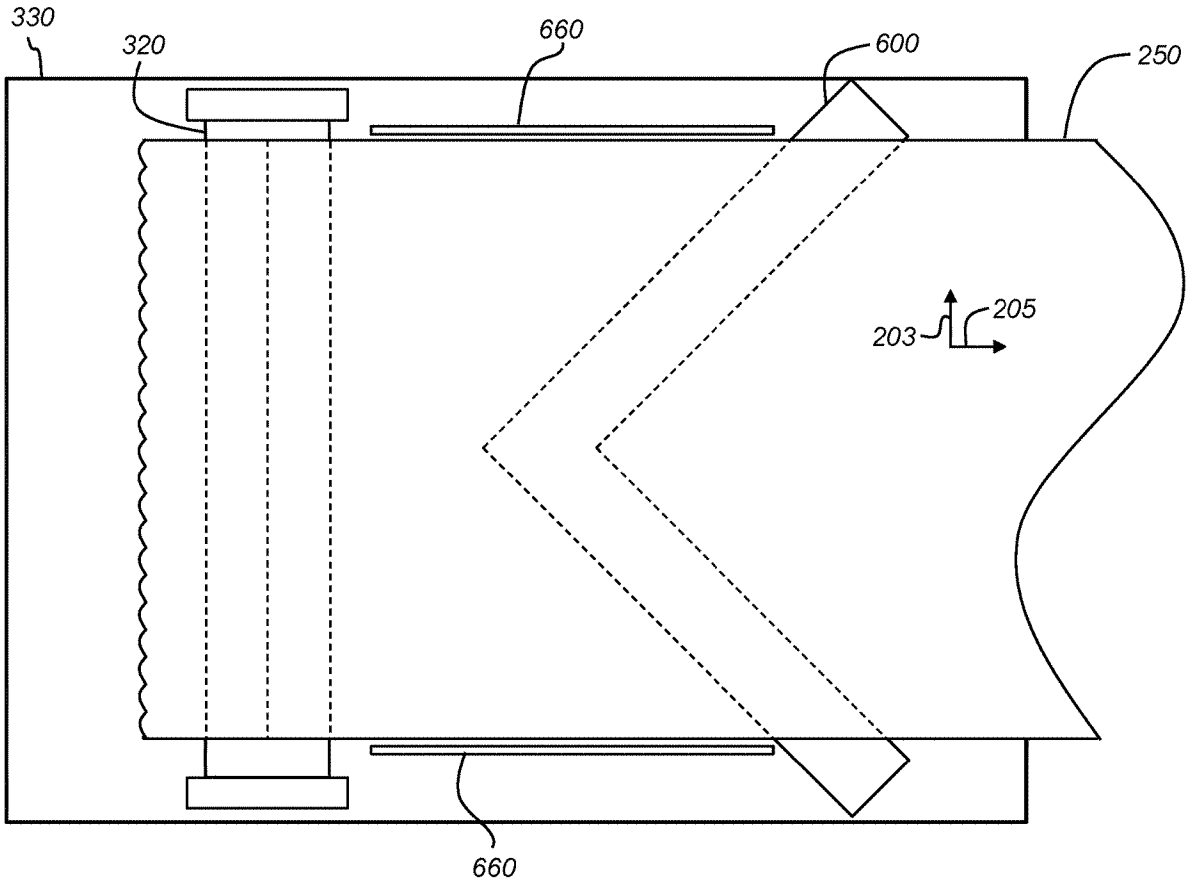
FIG. 18 shows a schematic top view of a processing tank including an air skive with a V-blade configuration.
Figure 19:
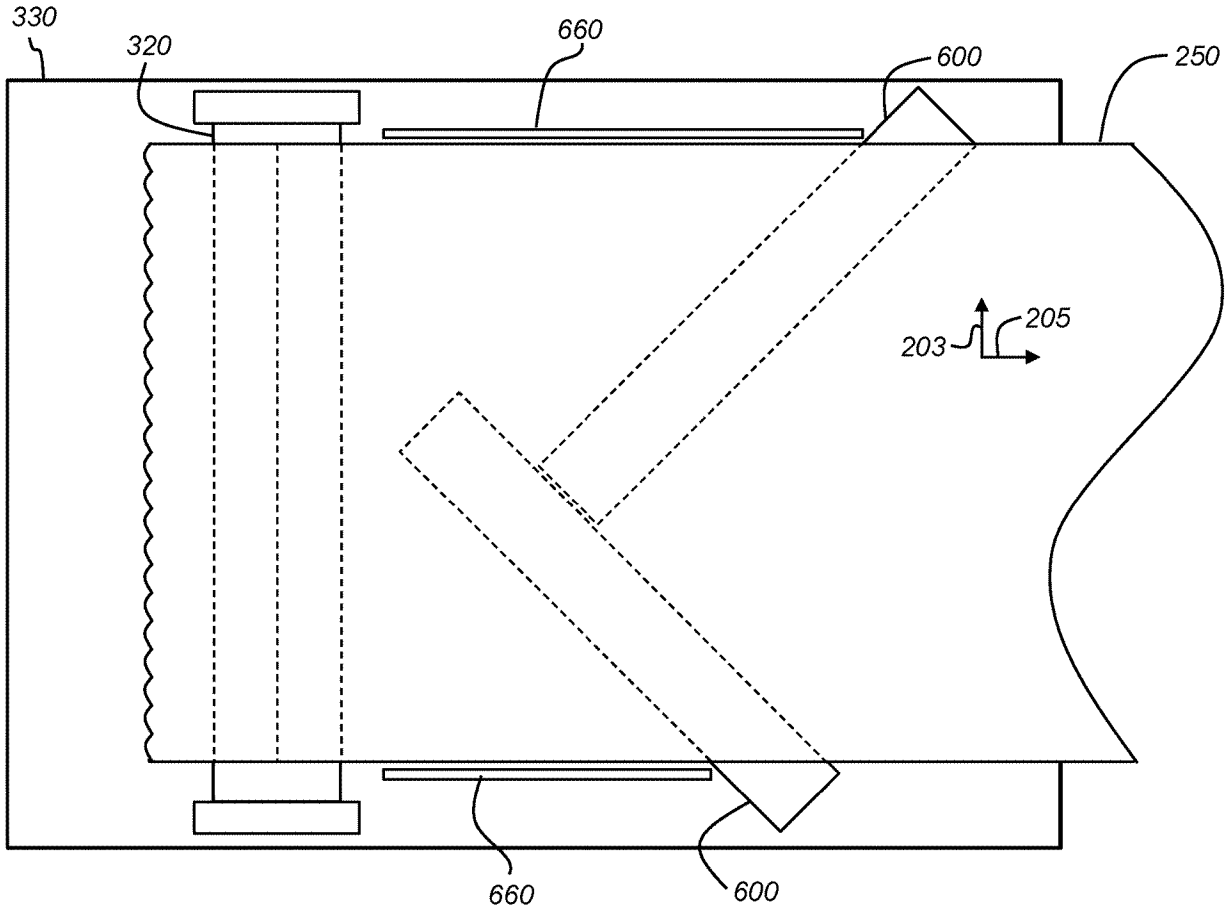
FIG. 19 shows a schematic top view of a processing tank including two air skives providing a V-blade configuration.
Figure 20:
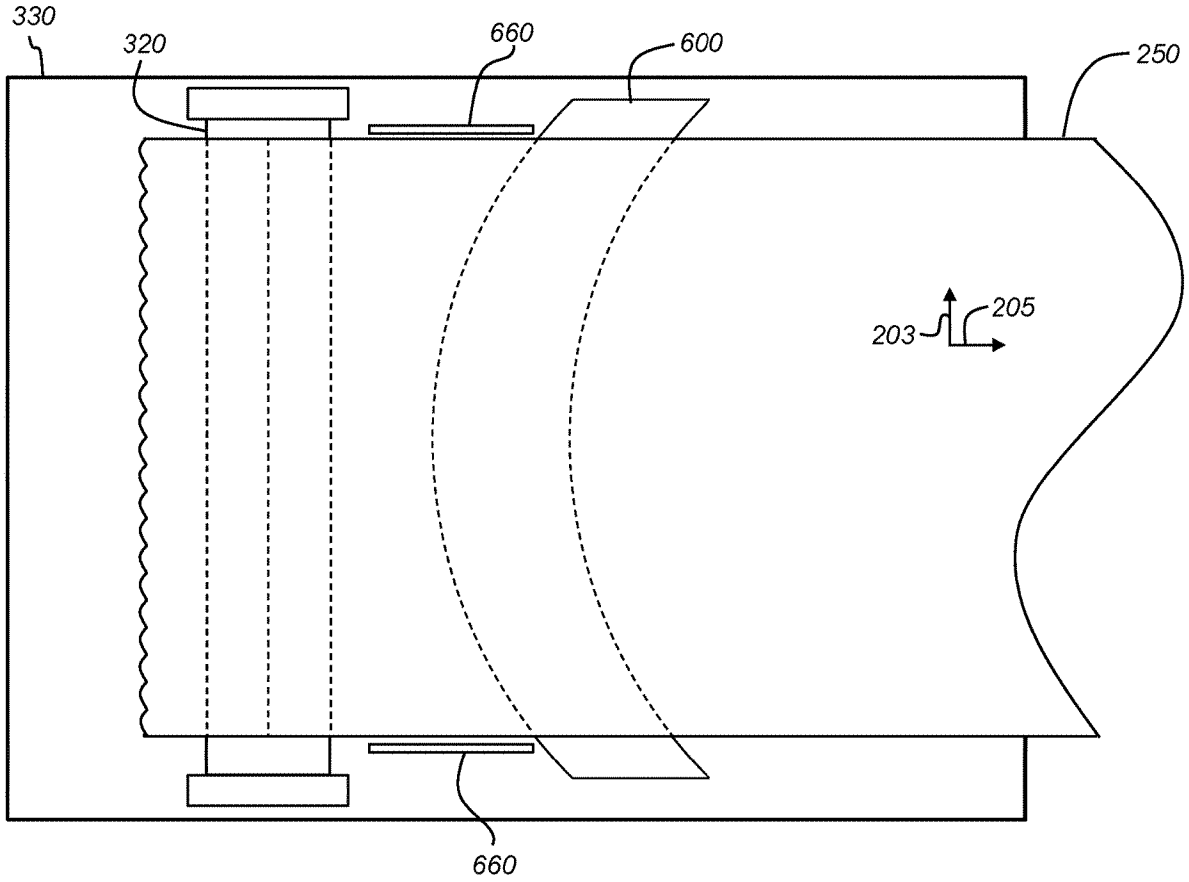
FIG. 20 shows a schematic top view of a processing tank including a curved air skive.

In various embodiments, the air skive 600 can be oriented in a number of ways as it spans the web of media 250. FIG. 16 illustrates a schematic top view of a processing tank 330 including an air skive 600 positioned an embodiment in which the air skive 600 is oriented normal to the in-track direction 205 (i.e., the direction of media travel) as viewed from above the plane of the web of media 250. FIG. 17 illustrates an embodiment in which the air skive 600 is oriented at an oblique angle to the in-track direction 205. This enables the air skive 600 to act as a plow to push the liquid off the side of the web of media 250. The air skive 600 of FIG. 18 is configured in the form of a V-blade such that liquid can be plowed off both edges of the web of media 250. FIG. 19 illustrates an air skive configuration that operates similar to that of FIG. 18, but is made up of two overlapping straight air skives 600. FIG. 20 illustrates a configuration in which the contour of the air skive 600 across the width of the web of media 250 is curved instead of straight.

Figure 21:
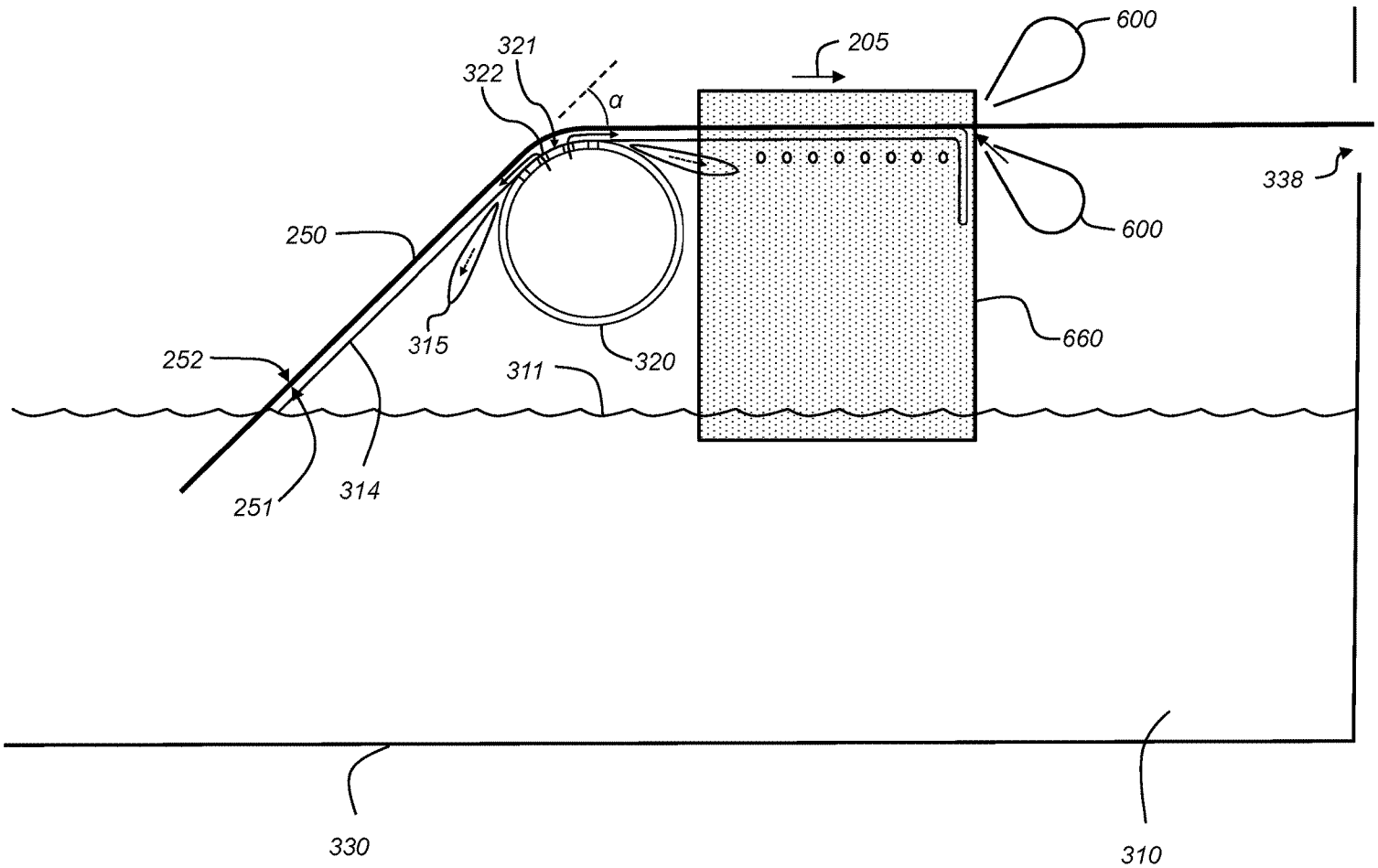
FIG. 21 shows a schematic side view of a processing tank including an air skive positioned downstream of a non-submerged web guide together with splash shields.

As the stream of air coming out of the air skives 600 can cause the liquid to splash off the edges of the web of media 250, some embodiments include splash shields 660 positioned adjacent to one or both edges of the web of media 250 to contain the liquid, as shown in FIGS. 16-20. These splash shields 660 can extend down to the surface of the liquid in the processing tank 330, as shown in FIG. 21, to allow the collected liquid to flow down into the processing tank 330 without splashing onto the surface of the processing liquid 310 or generating air bubbles in the processing liquid 310.

The illustrated exemplary embodiments have been directed to removing liquid from the surface of a web of media 250 guided through a roll-to-roll liquid processing system using air skives 600 providing streams of air including vapor provided by vapor sources 630. In the described configurations, the liquid on the surface of a web of media 250 originates from liquid turn bars (e.g., non-contact web guides 320), or from liquid being entrained on the surface of the web of media 250 as it exits a processing tank 330. However, the air skives 600 of the present invention are appropriate for use with any type of liquid application system in which liquid is applied to at least one surface of the web of media 250. Other examples of liquid application systems would include spraying systems which spray a liquid onto at least one surface of the web of media 250, roll-coating systems which coat a liquid onto at least one surface of the web of media 250 by bringing the web of media into contact with a roller having a layer of the liquid on its surface.

Figure 22:
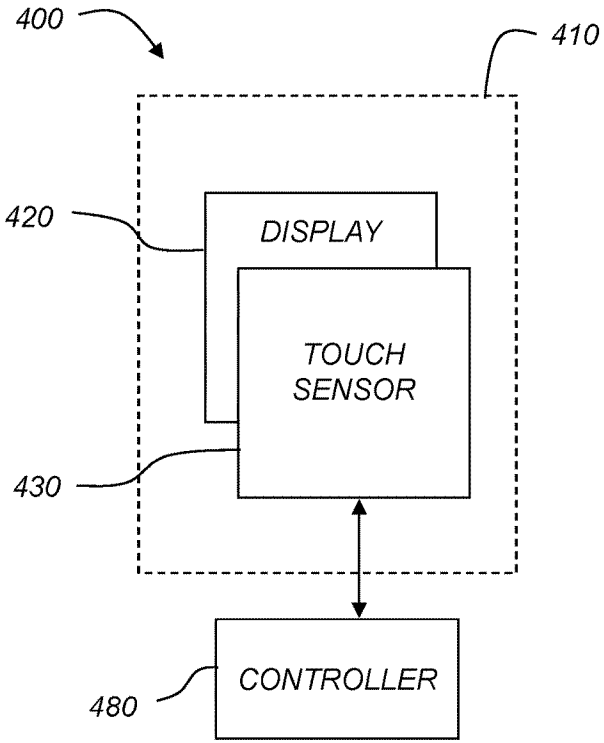
FIG. 22 is a high-level system diagram for an apparatus having a touch screen with a touch sensor that can be printed using embodiments of the invention.

FIG. 22 shows a high-level system diagram for an apparatus 400 having a touch screen 410 including a display device 420 and a touch sensor 430 that overlays at least a portion of a viewable area of display device 420. Touch sensor 430 senses touch and conveys electrical signals (related to capacitance values for example) corresponding to the sensed touch to a controller 480. Touch sensor 430 is an example of an article that can be printed on one or both sides by the flexographic printing system 100 and plated using an embodiment of roll-to-roll liquid processing system 300 where the web of media 250 is guided by non-contact web guides having liquid ejection hole configurations as described above.

Figure 23:
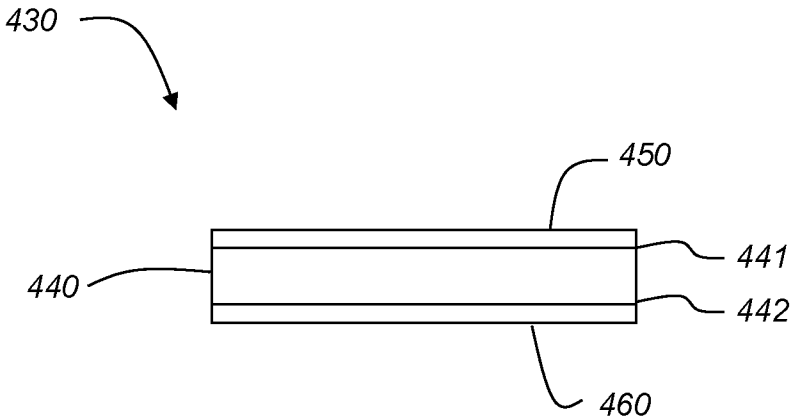
FIG. 23 is a side view of the touch sensor of FIG. 22.

FIG. 23 shows a schematic side view of a touch sensor 430. Transparent substrate 440, for example polyethylene terephthalate, has a first conductive pattern 450 printed and plated on a first side 441, and a second conductive pattern 460 printed and plated on a second side 442. The length and width of the transparent substrate 440, which is cut from the take-up roll 104 (FIG. 1), is not larger than the flexographic printing plates 112, 122, 132, 142 of flexographic printing system 100 (FIG. 1), but it could be smaller than the flexographic printing plates 112, 122, 132, 142.

Figure 24:
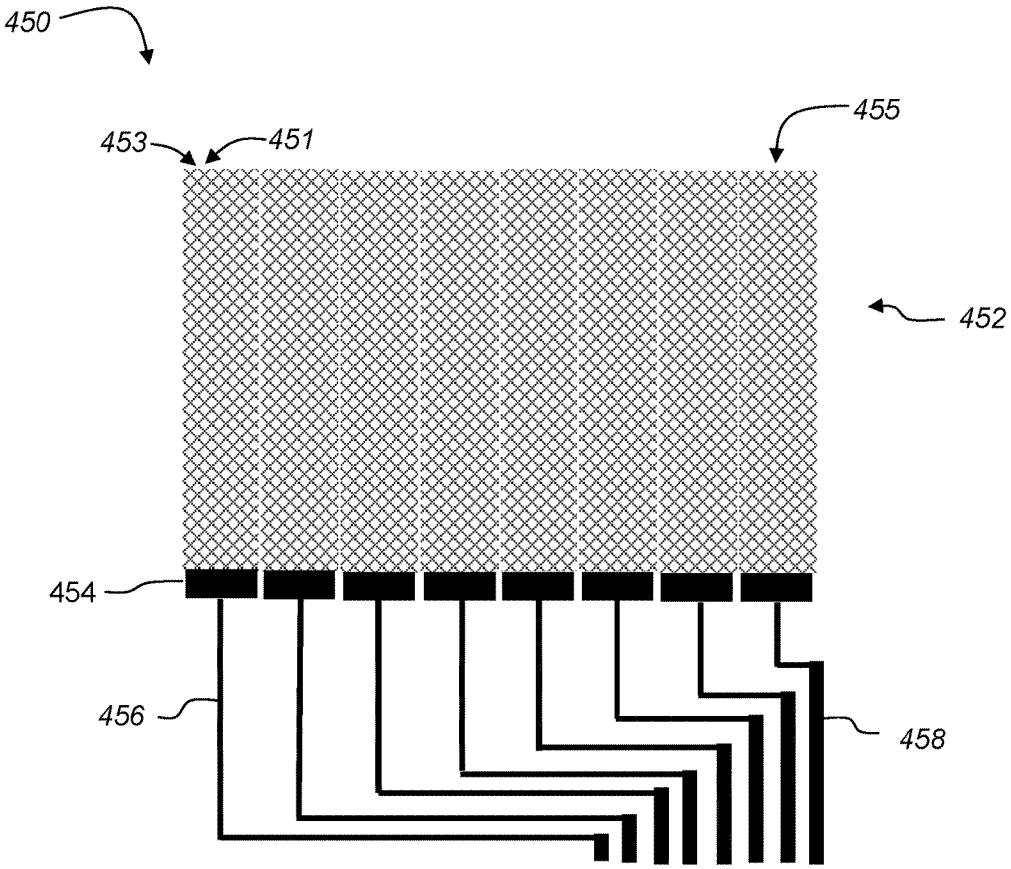
FIG. 24 is a top view of a conductive pattern printed on a first side of the touch sensor of FIG. 23.

FIG. 24 shows an example of a conductive pattern 450 that can be printed on first side 441 (FIG. 23) of transparent substrate 440 (FIG. 23) using one or more print modules such as print modules 120 and 140 of flexographic printing system (FIG. 1), followed by plating using a roll-to-roll liquid processing system 300 (FIG. 3). Conductive pattern 450 includes a grid 452 including grid columns 455 of intersecting fine lines 451 and 453 that are connected to an array of channel pads 454. Interconnect lines 456 connect the channel pads 454 to the connector pads 458 that are connected to controller 480 (FIG. 22). Conductive pattern 450 can be printed by a single print module 120 in some embodiments. However, because the optimal print conditions for fine lines 451 and 453 (e.g., having line widths on the order of 4 to 8 microns) are typically different than for printing the wider channel pads 454, connector pads 458 and interconnect lines 456, it can be advantageous to use one print module 120 for printing the fine lines 451 and 453 and a second print module 140 for printing the wider features. Furthermore, for clean intersections of fine lines 451 and 453, it can be further advantageous to print and cure one set of fine lines 451 using one print module 120, and to print and cure the second set of fine lines 453 using a second print module 140, and to print the wider features using a third print module (not shown in FIG. 1) configured similarly to print modules 120 and 140.

Figure 25:
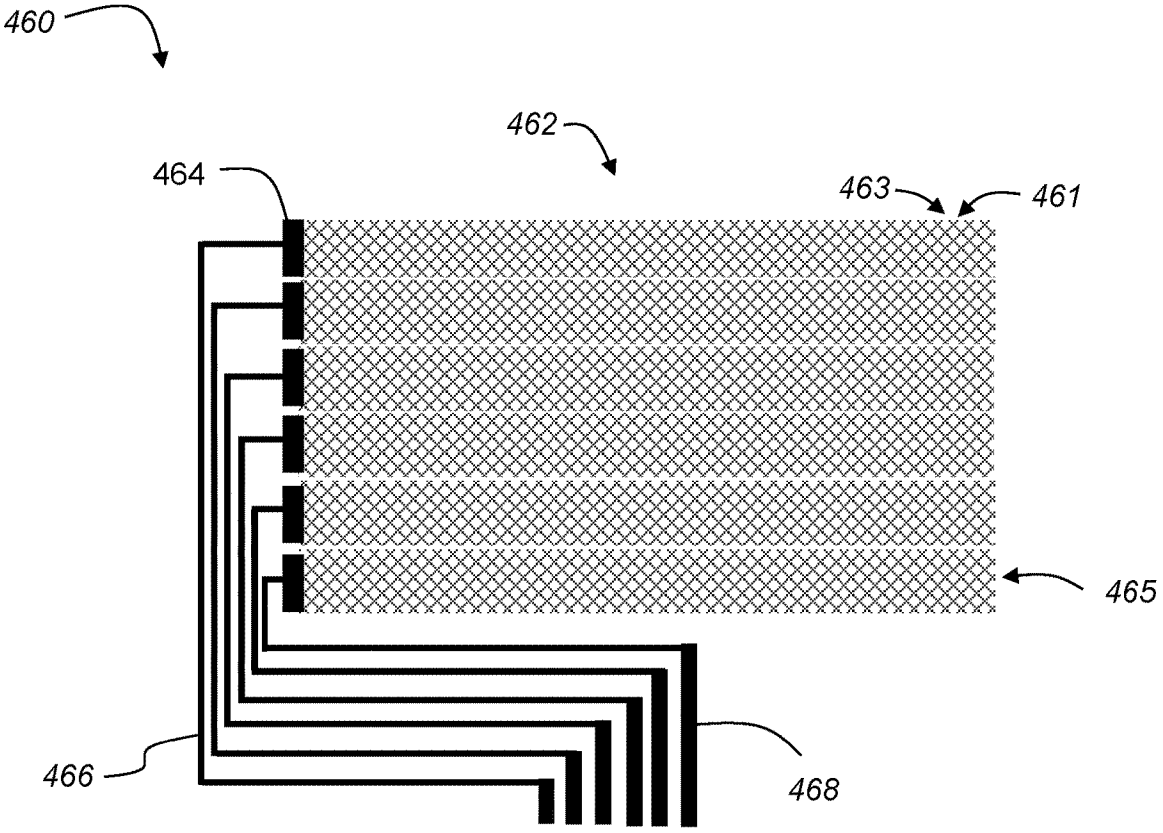
FIG. 25 is a top view of a conductive pattern printed on a second side of the touch sensor of FIG. 23.

FIG. 25 shows an example of a conductive pattern 460 that can be printed on second side 442 (FIG. 23) of substrate 440 (FIG. 23) using one or more print modules such as print modules 110 and 130 of flexographic printing system (FIG. 1), followed by plating using a roll-to-roll liquid processing system 300 (FIG. 3). Conductive pattern 460 includes a grid 462 including grid rows 465 of intersecting fine lines 461 and 463 that are connected to an array of channel pads 464. Interconnect lines 466 connect the channel pads 464 to the connector pads 468 that are connected to controller 480 (FIG. 22). In some embodiments, conductive pattern 460 can be printed by a single print module 110. However, because the optimal print conditions for fine lines 461 and 463 (e.g., having line widths on the order of 4 to 8 microns) are typically different than for the wider channel pads 464, connector pads 468 and interconnect lines 466, it can be advantageous to use one print module 110 for printing the fine lines 461 and 463 and a second print module 130 for printing the wider features. Furthermore, for clean intersections of fine lines 461 and 463, it can be further advantageous to print and cure one set of fine lines 461 using one print module 110, and to print and cure the second set of fine lines 463 using a second print module 130, and to print the wider features using a third print module (not shown in FIG. 1) configured similarly to print modules 110 and 130.

Alternatively, in some embodiments conductive pattern 450 can be printed using one or more print modules configured like print modules 110 and 130, and conductive pattern 460 can be printed using one or more print modules configured like print modules 120 and 140 of FIG. 1 followed by plating using a roll-to-roll liquid processing system.

With reference to FIGS. 22-25, in operation of touch screen 410, controller 480 can sequentially electrically drive grid columns 455 via connector pads 458 and can sequentially sense electrical signals on grid rows 465 via connector pads 468. In other embodiments, the driving and sensing roles of the grid columns 455 and the grid rows 465 can be reversed.

The invention has been described in detail with particular reference to certain preferred embodiments thereof, but it will be understood that variations and modifications can be effected within the spirit and scope of the invention.

PARTS LIST

100 flexographic printing system
102 supply roll
104 take-up roll
105 roll-to-roll direction
106 roller
107 roller
110 print module
111 plate cylinder
112 flexographic printing plate
113 raised features
114 impression cylinder
115 anilox roller
116 UV curing station
120 print module
121 plate cylinder
122 flexographic printing plate
124 impression cylinder
125 anilox roller
126 UV curing station
130 print module
131 plate cylinder
132 flexographic printing plate
134 impression cylinder
135 anilox roller
136 UV curing station
140 print module
141 plate cylinder
142 flexographic printing plate
144 impression cylinder
145 anilox roller
146 UV curing station
150 substrate
151 first side
152 second side
200 roll-to-roll electroless plating system
202 supply roll
203 cross-track direction
204 take-up roll
205 in-track direction
206 drive roller
207 drive roller
208 web-guiding roller
210 plating solution
215 replenished plating solution
220 reservoir
230 tank
232 drain pipe
234 return pipe
236 filter
240 pump
242 controller
250 web of media
251 first surface
252 second surface
253 first edge
254 second edge
300 roll-to-roll liquid processing system
301 web transport system
302 non-submerged web guide
304 submerged web guide
305 processing liquid
**305*a*** processing liquid
**305*b*** processing liquid
**305*c*** processing liquid
**305*d*** processing liquid
310 processing liquid
311 liquid level
312 sheet of liquid
313 drips
314 sheet of liquid
315 deflected liquid
316 deflected liquid
318 entrained liquid
320 web guide
**320*a*** web guide (fluid bar)
**320*b*** web guide (fluid bar)
**320*c*** web guide (fluid bar)
321 bearing surface
322 liquid ejection holes
323 first end
324 second end
325 first mount
326 second mount
327 hollow interior
328 curved wall
329 curved exterior surface
330 processing tank
335 processing tank
336 entrance
337 entrance wall
338 exit
340 processing tank
345 processing tank
350 scavenger blade
354 flow arrow
360 four-stage processing tank
361 processing tank
362 processing tank
363 processing tank
364 processing tank
365 end wall
366 opening
368 partition
400 apparatus
410 touch screen
420 display device
430 touch sensor
440 transparent substrate
441 first side
442 second side
450 conductive pattern
451 fine lines
452 grid
453 fine lines
454 channel pads
455 grid column
456 interconnect lines
458 connector pads
460 conductive pattern
461 fine lines
462 grid
463 fine lines
464 channel pads

465 grid row
466 interconnect lines
468 connector pads
480 controller
500 web transport path
501 first array
502 second array
505 intermediate array
510 input travel direction
511 output travel direction
531 web guide entry position
532 web guide exit position
600 air skive
600*a* air skive
600*b* air skive
600*c* air skive
602 air source
604 nozzle
606 plenum
608 stream of air
612 gap
614 upstream edge
616 downstream edge
618 upstream stream of air
620 downstream stream of air
622 flow diverter
624 attached liquid
626 terminating edge
628 drop
630 vapor source
632 air duct
634 wicking material
636 conduit
638 collection pan
640 pump
642 conditioning unit
644 reservoir
646 atomizer
648 mist
650 baffle
652 reservoir
654 ultrasonic transducer
656 liquid
658 sensor
660 splash shields
T wall thickness
S stand-off distance
W width
$R_1$ first row
$R_2$ second row
$\alpha$ wrap angle

The invention claimed is:

1. A web transport system for transporting a web of media along a web transport path in an in-track direction, comprising: a liquid application system for applying a liquid to at least one surface of the web of media;

an air skive positioned along the web transport path downstream of the liquid application system, wherein the air skive directs one or more streams of air onto the web of media to remove at least some of the liquid that is being carried along with the web of media; a vapor source that adds a vapor into the one or more streams of air provided by the air skive before the one or more streams of air are directed onto the web of media;

wherein the liquid application system includes a liquid turn bar positioned along the web transport path upstream of the air skive for non-contact guidance of the web of media;

wherein the web of media passes through a processing liquid in a processing tank, and wherein the liquid turn bar is positioned over the processing liquid in the processing tank with at least a portion of the liquid turn bar not being submerged in the processing liquid.

2. The web transport system of claim 1, wherein the liquid turn bar includes:

a wall having a curved exterior surface, wherein the web of media travels along the web transport path around a bearing portion of the curved exterior surface from an entry position to an exit position, such that the web of media is redirected from an input travel direction to an output travel direction; and one or more liquid ejection holes formed through the wall, wherein a pressurized liquid flows through the one or more liquid ejection holes to force the web of media away from the curved exterior surface of the liquid turn bar so that the web of media does not contact the liquid turn bar as it travels around the bearing portion of the curved exterior surface.

3. The web transport system of claim 1, wherein the web of media has a first surface and an opposing second surface, and wherein the air skive directs streams of air onto both the first and second surfaces.

4. The web transport system of claim 1, wherein the vapor source injects vapor into the one or more streams of air.

5. The web transport system of claim 1, wherein the vapor source adds vapor into the one or more streams of air by passing the air over a wicking pad moistened with a liquid form of the vapor.

6. The web transport system of claim 1, wherein the vapor source adds vapor into the one or more streams of air by passing the air through a mist formed from a liquid form of the vapor using one or more atomizers.

7. The web transport system of claim 1, wherein the vapor source adds vapor into the one or more streams of air by passing the air through a mist formed using one or more ultrasonic transducers in a reservoir containing a liquid form of the vapor.

8. The web transport system of claim 1, wherein the vapor is a gaseous form of the liquid applied by the liquid application system.

9. The web transport system of claim 1, wherein the vapor is a gaseous form of one or more components of the liquid applied by the liquid application system.

10. The web transport system of claim 1, wherein the vapor is water vapor.

11. The web transport system of claim 1, wherein the liquid application system includes a processing tank containing the liquid, and wherein the web of media travels along the web transport path through the liquid in the processing tank.

12. The web transport system of claim 1, wherein the liquid application system is a spraying system which sprays the liquid onto at least one surface of the web of media.

13. The web transport system of claim 1, wherein the liquid application system is a roll coating system which coats the liquid onto at least one surface of the web of media by bringing the web of media into contact with a roller having a layer of the liquid on its surface.

14. The web transport system of claim 1, further including:

a humidity sensor for sensing an amount of vapor in the one or more streams of air; and a control system for controlling an amount of vapor added to the one or more streams of air by the vapor source responsive to the sensed amount of vapor.

15. The web transport system of claim 1, wherein the liquid applied by the liquid application system is a processing liquid that performs a chemical process on the web of media.

16. The web transport system of claim 15, wherein the processing liquid is an electroless plating solution.

17. A web transport system for transporting a web of media along a web transport path in an in-track direction, comprising:

a liquid application system for applying a liquid to at least one surface of the web of media;

an air skive positioned along the web transport path downstream of the liquid application system, wherein the air skive directs one or more streams of air onto the web of media thereby removing at least some of the liquid that is being carried along with the web of media;

a vapor source that adds a vapor into the one or more streams of air provided by the air skive before the one or more streams of air are directed onto the web of media;

a humidity sensor for sensing an amount of vapor in the one or more streams of air; and a control system for controlling an amount of vapor added to the one or more streams of air by the vapor source responsive to the sensed amount of vapor.

* * * * *